US007223149B2

(12) United States Patent
Thai

(10) Patent No.: US 7,223,149 B2
(45) **Date of Patent: *May 29, 2007**

(54) BUBBLE GENERATING ASSEMBLY

(75) Inventor: Douglas Thai, Walnut, CA (US)

(73) Assignee: Arko Development Ltd. (HK), Hong Kong (HK)

( * ) Notice: Subject to any disclaimer, the term of this patent is extended or adjusted under 35 U.S.C. 154(b) by 43 days.

This patent is subject to a terminal disclaimer.

(21) Appl. No.: 11/129,535

(22) Filed: May 13, 2005

(65) Prior Publication Data

US 2005/0221714 A1 Oct. 6, 2005

Related U.S. Application Data

(63) Continuation of application No. 10/693,157, filed on Oct. 24, 2003, now Pat. No. 6,893,314, which is a continuation-in-part of application No. 10/655,805, filed on Sep. 5, 2003, now Pat. No. 6,988,926, which is a continuation of application No. 10/195,816, filed on Jul. 15, 2002, now Pat. No. 6,620,016, which is a continuation-in-part of application No. 10/133,195, filed on Apr. 26, 2002, now Pat. No. 6,659,831, which is a continuation-in-part of application No. 10/099,431, filed on Mar. 15, 2002, now Pat. No. 6,659,834.

(51) Int. Cl.
*A63H 33/28* (2006.01)

(52) U.S. Cl. ..... 446/15; 446/20; 446/484

(58) Field of Classification Search ..... 446/15, 446/16, 17, 18, 19, 20, 21, 475, 484, 176, 446/178, 179, 180, 473
See application file for complete search history.

(56) References Cited

U.S. PATENT DOCUMENTS

| | | | |
|---|---|---|---|
| 430,095 | A | 6/1890 | Thain |
| 616,239 | A | 12/1898 | King |
| 2,041,423 | A | 5/1936 | Mausolf |
| 2,213,391 | A | 9/1940 | Gamble |
| 2,225,702 | A | 12/1940 | Lyon, Jr, |
| 2,396,433 | A | 3/1946 | Pimblett |
| 2,527,935 | A | 10/1950 | Joel, II |
| 2,547,825 | A | 4/1951 | King |
| 2,560,582 | A | 7/1951 | Limber |
| 2,587,537 | A | 2/1952 | Scott |
| 2,606,396 | A | 8/1952 | Hill |
| 2,632,281 | A | 3/1953 | Schmidt, Jr. |
| 2,659,177 | A | 11/1953 | Kopf |
| 2,700,845 | A | 2/1955 | Arliss |
| 2,711,051 | A | 6/1955 | Pick |
| 2,736,988 | A | 3/1956 | Fisher |
| 2,974,438 | A | 3/1961 | Hopkins |
| 2,987,847 | A | 6/1961 | Jones |
| 3,071,888 | A | 1/1963 | Knott |

(Continued)

*Primary Examiner*—Nini F. Legesse
(74) *Attorney, Agent, or Firm*—Raymond Sun

(57) ABSTRACT

A bubble generating assembly has a housing, a bubble solution supply, a bubble generating frame, and a tubing that couples the bubble solution supply with the bubble generating frame. The bubble generating frame has two separate portions, the portions being pivotably coupled to each other in a manner such that the portions can be pivoted between a closed position where the front surface of the portions contact each other, and an opened position where the portions are positioned in the same plane to form the bubble generating frame.

10 Claims, 23 Drawing Sheets

U.S. PATENT DOCUMENTS

| | | | | |
|---|---|---|---|---|
| 3,100,947 | A | 8/1963 | Hellman | |
| 3,109,255 | A | 11/1963 | Hein | |
| 3,183,621 | A | 5/1965 | Allen, Jr. | |
| 3,228,136 | A | 1/1966 | Rouse | |
| 3,323,250 | A | 6/1967 | Gibbons | |
| 3,420,412 | A | 1/1969 | Greene | |
| 3,579,898 | A | 5/1971 | Hein | |
| 3,601,313 | A | 8/1971 | Berg | |
| 3,604,144 | A | 9/1971 | Span | |
| 3,731,412 | A | 5/1973 | Winslow | |
| 3,736,694 | A | 6/1973 | Lebensfeld | |
| 3,845,583 | A | 11/1974 | Ziff | |
| 3,913,260 | A | 10/1975 | Corbett | |
| 3,925,923 | A | 12/1975 | La Fata et al. | |
| 3,952,447 | A | 4/1976 | Hackell | |
| 4,246,717 | A | 1/1981 | Wachtel | |
| D263,062 | S | 2/1982 | Rasmussen | |
| 4,423,565 | A | 1/1984 | Bart | |
| 4,438,955 | A | 3/1984 | Ryan | |
| 4,467,552 | A | 8/1984 | Jernigan | |
| 4,481,731 | A | 11/1984 | La Fata et al. | |
| 4,603,021 | A | 7/1986 | Urso | |
| 4,700,965 | A | 10/1987 | Kinberg | |
| 4,775,348 | A | 10/1988 | Collins | |
| 4,804,346 | A | 2/1989 | Sheng | |
| RE32,973 | E | 7/1989 | Panzarella | |
| D304,466 | S | 11/1989 | Glickman | |
| 4,957,464 | A | 9/1990 | Perez | |
| 4,988,319 | A | 1/1991 | Sheng | |
| 5,035,665 | A | 7/1991 | Sheng | |
| 5,230,648 | A | 7/1993 | Kelley et al. | |
| 5,234,129 | A | 8/1993 | Lau | |
| 5,395,274 | A | 3/1995 | Myers | |
| 5,462,469 | A | 10/1995 | Lei | |
| 5,498,191 | A | 3/1996 | DeMars | |
| 5,520,564 | A | 5/1996 | DeMars | |
| 5,542,869 | A | 8/1996 | Petty | |
| 5,613,890 | A | 3/1997 | DeMars | |
| 5,695,379 | A | 12/1997 | Ho | |
| 5,832,969 | A | 11/1998 | Schramm | |
| 5,842,899 | A | 12/1998 | Cernansky et al. | |
| 5,850,945 | A | 12/1998 | Frankel | |
| 5,879,218 | A | 3/1999 | Tao | |
| 6,062,935 | A | 5/2000 | Gross | |
| 6,102,764 | A | 8/2000 | Thai | |
| 6,139,391 | A | 10/2000 | Thai et al. | |
| 6,149,486 | A | 11/2000 | Thai | |
| 6,200,184 | B1 | 3/2001 | Rich et al. | |
| 6,315,627 | B1 | 11/2001 | Thai | |
| 6,331,130 | B1 | 12/2001 | Thai | |
| 6,416,377 | B1 | 7/2002 | Bart | |
| 6,544,091 | B1 | 4/2003 | Thai | |
| 6,547,622 | B2 | 4/2003 | Thai | |
| 6,620,016 | B1 | 9/2003 | Thai | |
| 6,659,830 | B2 | 12/2003 | Thai | |
| 6,893,314 | B2 * | 5/2005 | Thai | 446/15 |
| 6,988,926 | B2 * | 1/2006 | Thai | 446/15 |

* cited by examiner

BUBBLE GENERATING ASSEMBLY

RELATED CASES

This is a continuation of Ser. No. 10/693,157, filed Oct. 24, 2003, now U.S. Pat. No. 6,893,314, which is a continuation-in-part of Ser. No. 10/655,805, entitled "Bubble Generating Assembly", filed Sep. 5, 2003, now U.S. Pat. No. 6,988,926 which is in turn a continuation of Ser. No. 10/195,816, entitled "Bubble Generating Assembly", filed Jul. 15, 2002, now U.S. Pat. No. 6,620,016, which is a continuation-in-part of Ser. No. 10/133,195, entitled "Apparatus and Method for Delivering Bubble Solution to a Dipping Container", filed Apr. 26, 2002, now U.S. Pat. No. 6,659,831 which is in turn a continuation-in-part of Ser. No. 10/099,431, entitled "Apparatus and Method for Delivering Bubble Solution to a Dipping Container", filed Mar. 15, 2002, now U.S. Pat. No. 6,659,834, whose disclosures are incorporated by this reference as though fully set forth herein.

BACKGROUND OF THE INVENTION

1. Field of the Invention

The present invention relates to bubble toys, and in particular, to a bubble generating assembly which automatically forms a bubble film over a bubble ring without the need to dip the bubble ring into a container or a dish of bubble solution.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Thus, there remains a need to provide an apparatus and method for forming a film of bubble solution across a bubble ring without the need to dip the bubble ring into a dish of bubble solution.

SUMMARY OF THE DISCLOSURE

It is an object of the present invention to provide an apparatus and method for effectively forming a film of bubble solution across a bubble ring.

It is another object of the present invention to provide an apparatus and method for effectively forming a film of bubble solution across a bubble ring in a manner which minimizes spillage of the bubble solution.

It is yet another object of the present invention to provide an apparatus having a simple construction that effectively forms a film of bubble solution across a bubble ring.

It is yet a further object of the present invention to provide an apparatus and method for effectively forming films of bubble solution across a plurality of bubble rings.

The objectives of the present invention are accomplished by providing a bubble generating assembly that has a housing, a bubble solution supply, a bubble generating frame, and a tubing that couples the bubble solution supply with the bubble generating frame. The bubble generating frame has two separate portions, the portions being pivotably coupled to each other in a manner such that the portions can be pivoted between a closed position where the front surface of the portions contact each other, and an opened position where the portions are positioned in the same plane to form the bubble generating frame.

The bubble generating assembly of the present invention can also include a pressure roller that removably compresses the tubing to draw bubble solution from the bubble solution supply to the bubble generating frame.

DETAILED DESCRIPTION OF THE PREFERRED EMBODIMENTS

Figure 1:
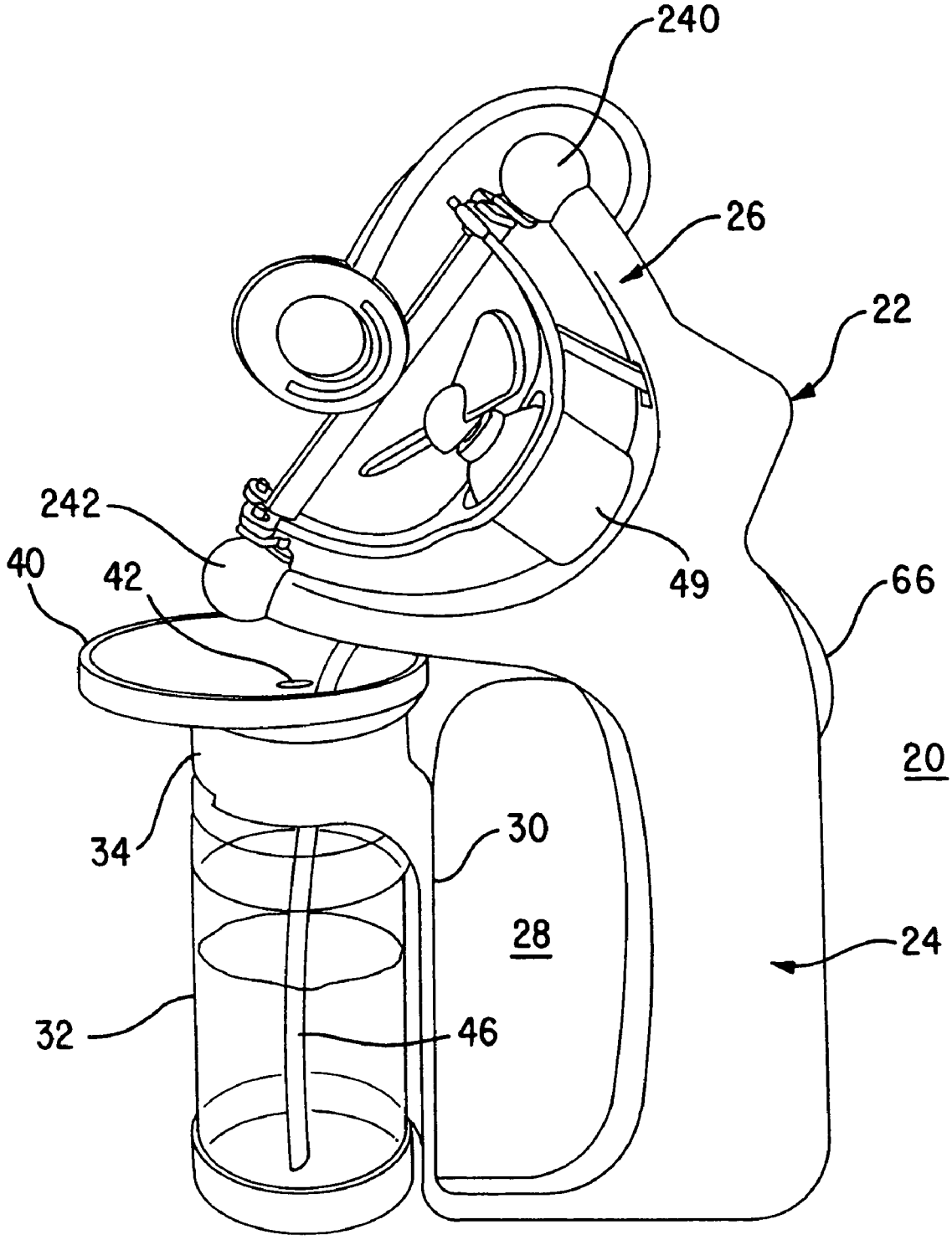
FIG. 1 is a perspective view of a bubble generating assembly according to one embodiment of the present invention shown with the two bubble rings contacting each other.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1–13 illustrate one embodiment of a bubble generating assembly 20 according to the present invention. The assembly 20 has a housing 22 that includes a bottom or handle section 24 and an upper or bubble generating section 26. The housing 22 can be provided in the form of two symmetrical outer shells that are connected together by, for example, screws or welding or glue. These outer shells together define a hollow interior for housing the internal components of the assembly 20, as described below. The handle section 24 has an opening 28 through which a user can extend his or her fingers to grip the handle section 24. The front wall 30 of the opening 28 defines a shielding wall against which a conventional bubble solution bottle 32 can be rested. The bubble solution bottle 32 can be provided in the form of any of the conventional bubble solution containers that are currently available in the marketplace. A connecting section 34, which resembles an annular wall, extends from the front of the top of the front wall 30, and has internal threads 36 (see also FIGS. 4 and 5) that are adapted to releasably engage the external threads 38 on the neck of the solution bottle 32. A solution dish 40 is secured to the top of the connecting section 34, and has a first opening 42 that communicates with the interior of the connecting section 34. The dish 40 also has a second opening 44 that communicates with the interior of the connecting section 34, and which receives a tube 46 that extends therethrough from the solution bottle 32 to the bubble generating section 26.

The handle section 24 houses a power source 48 which can include at least one conventional battery. The bubble generating section 26 has a motor housing 49 that houses a motor 50 that is electrically coupled to the power source 48 via a first wire 52 and a first electrical contact 54. A second wire 56 couples the motor 50 to a first end 58 of a second electrical contact 60, whose second curved end 62 is adapted to releasably contact a third electrical contact 64 that is coupled to the power supply 48. The second contact 60 is attached to the bottom leg 72 of a push button 66, which operates as a trigger mechanism.

Figure 5:
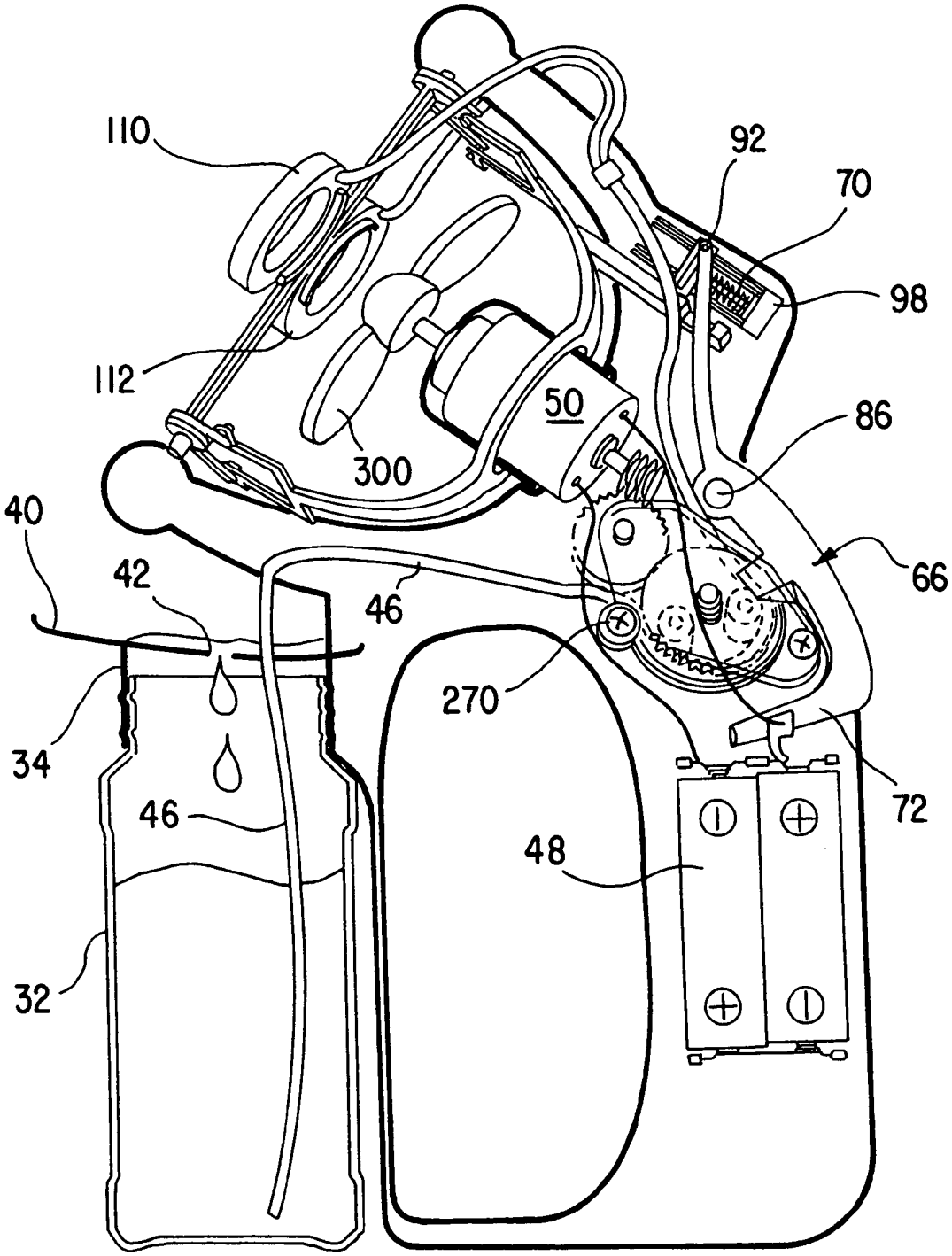
FIG. 5 is a cross-sectional view of the assembly of FIG. 1 shown with the two bubble rings positioned side by side with each other.
Figure 6:
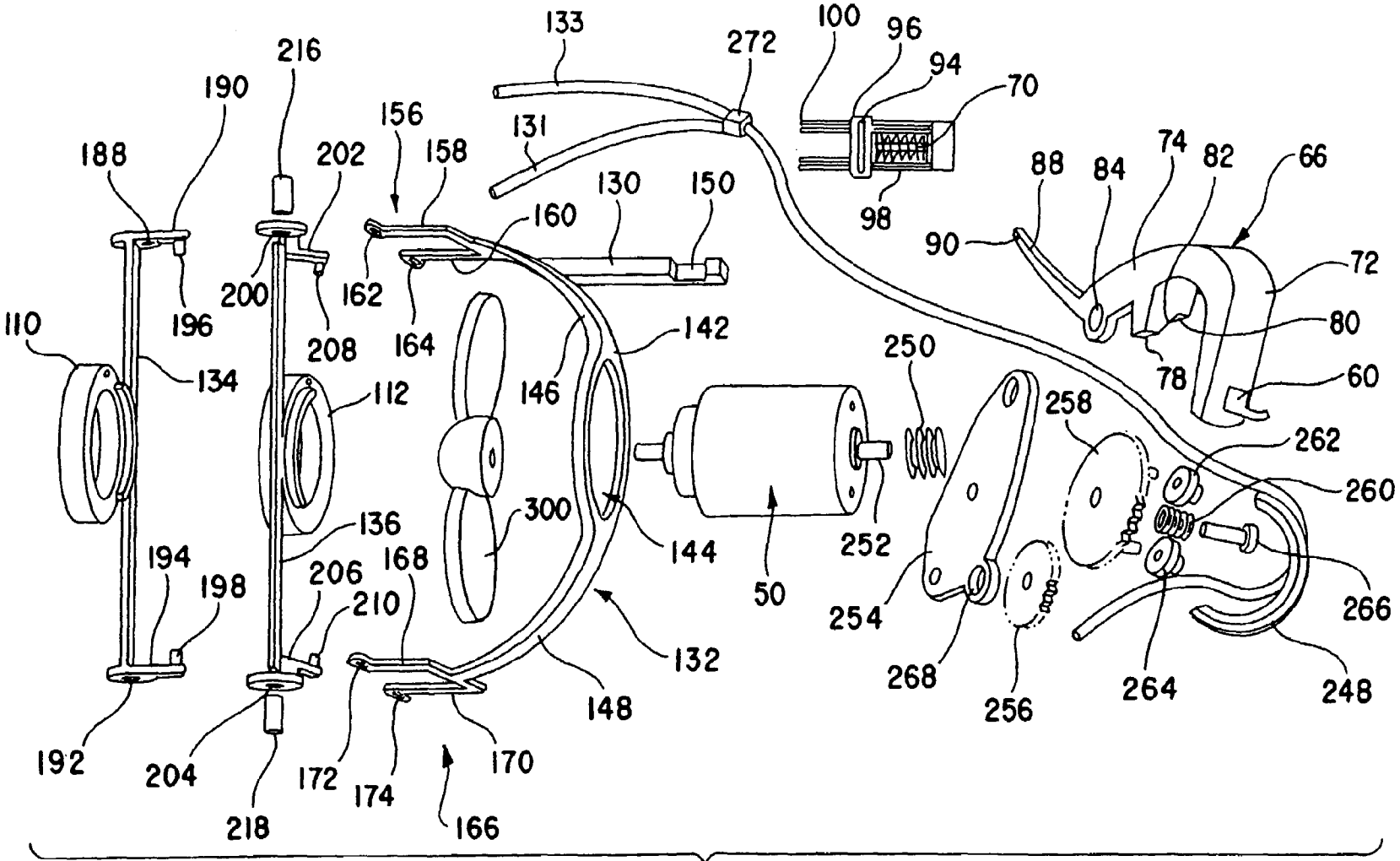
FIG. 6 is an exploded view illustrating the internal components of the assembly of FIG. 1.

The push button 66 is positioned at a rear side of the housing 22 between the handle section 24 and the bubble generating section 26, and extends through an opening 68 in the housing 22. Referring also to FIG. 6, the push button 66 has a generally L-shaped configuration with a bottom leg 72 and an elongated leg 74. A stepped extension 76 extends from the inner side of the elongated leg 74, and has a lower edge 78 and an upper edge 80 that are connected by an angled edge 82. The top end of the elongated leg 74 has a pivot opening 84 that receives a pivot shaft 86 (see FIGS. 4 and 5). A curved bar 88 extends from the top end of the elongated leg 74, and has a pivot opening 90 at its terminal end that receives a sliding shaft 92 (see FIGS. 4, 5, 8 and 9). The sliding shaft 92 is retained for reciprocating sliding movement inside a straight groove 94 of a locking piece 96 that is sleeved over a locking rack 98 (see also FIGS. 8–11). A shaft 99 (see FIG. 8) is attached to the locking piece 96 and extends in the interior of the locking rack 98, and a resilient element 70 (such as a spring) is retained over the shaft 99. The resilient element 70 normally biases the locking piece 96 towards a forward end 100 of the locking rack 98. As the locking piece 96 moves back and forth along the outer surface of the locking rack 98, the sliding shaft 92 slides up and down along the groove 94 (compare FIGS. 8 and 9) in a direction perpendicular to the direction of movement of the locking piece 96. The push button 66 is normally biased outwardly away from the housing 22 by the resilient element 70 which biases the locking piece 96 towards the forward end 100 of the locking rack 98. This causes the sliding shaft 92 to slide downwardly (see FIGS. 4 and 8) in the groove 94, which causes the bar 88 and the push button 66 to pivot in a counter-clockwise direction (as viewed from the orientation of FIGS. 4 and 5) about the pivot shaft 86, biasing the push button 66 outwardly away from the housing 22. As a result, the bias of the push button 66 means that the second contact 60 carried on the push button 66 is also normally biased away from the third contact 64 so that the motor 50 is not powered by the power source 48 under normal (non-operation) circumstances.

Figure 7:
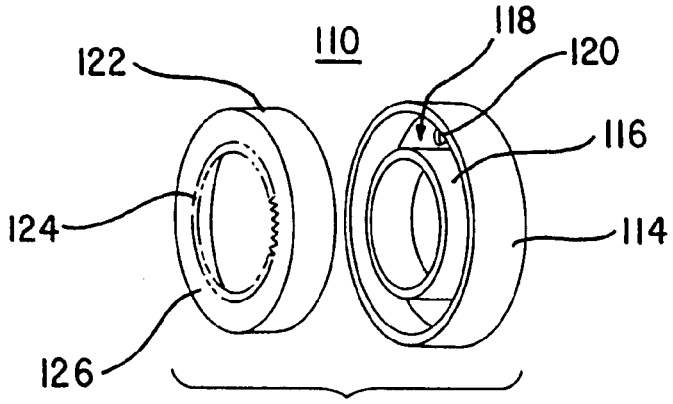
FIG. 7 is an exploded view of a bubble ring that can be used with the assembly of FIG. 1.

A pair of bubble generating rings 110 and 112 are provided outside the housing 22, and are adapted to be moved between a closed position (see FIGS. 1, 4 and 8), in which the front surfaces 126 of both rings 110, 112 contact each other, to an opened position (see FIGS. 2, 5 and 9), in which the rings 110, 112 are positioned side-by-side in the same plane. Each ring 110 and 112 can be identical in structure and operation, so only one ring 110 is illustrated in FIG. 7. The ring 110 has an annular base piece 114 that has a cylindrical wall 116 extending therein to define an annular chamber 118 therein. An opening 120 is provided in the base piece 114. The ring 110 also has an annular cover piece 122 that fits into the annular chamber 118 of the base piece 114. A plurality of outlets 124 can be provided along the inner annular surface, and/or the front surface 126, of the cover piece 122. Respective tubings 131 and 133 (see FIG. 6) are attached to the opening 120 of each ring 110, 112, to deliver bubble solution from the solution bottle 32 via the tube 46 into the chambers 118 of the respective rings 110, 112. The bubble solution from the chambers 118 can then leak out of the outlets 124 onto the front surface 126 of the rings 110, 112. When the bubble rings 110, 112 are in their normal non-operating (i.e., closed) position, the contact between the front surfaces 126 of the bubble rings 110, 112 will cause a film of bubble solution to be formed across each bubble ring 110, 112.

FIGS. 4–6 and 8–11 illustrate the link system that operatively couples the push button 66 to the bubble rings 110, 112. The link system includes the push button 66, the locking piece 96, the locking rack 98, a control bar 130, a generally U-shaped pivoting bar 132, and a ring support 134 and 136 for each respective bubble ring 110 and 112, respectively. The link system causes the bubble rings 110, 112 to move between the opened and closed positions when the push button 66 is pressed and released, respectively. The pivoting bar 132, the ring supports 134 and 136, and the rings 110, 112 are positioned outside the housing 22, while the control bar 130 is positioned partially outside the housing 22.

Referring to FIG. 6, the U-shaped pivoting bar 132 has a central section 142 that has an opening 144 through which the motor 50 can extend. A curved upper section 146 extends from one end of the central section 142, and a curved lower section 148 extends from one end of the central section 142. The control bar 130 is a straight bar that extends from a location along the upper section 146. The control bar 130 has a groove 150 through which the curved bar 88 of the push button 66 extends. An upper U-shaped prong 156 extends from the top end of the upper section 146, the upper U-shaped prong 156 having a first leg 158 and a second leg 160. Each leg 158 and 160 has a rounded end that has a corresponding elongated opening 162 and 164, respectively. Similarly, a lower U-shaped prong 166 extends from the bottom end of the lower section 148, the lower U-shaped prong 166 having a first leg 168 and a second leg 170. Each leg 168 and 170 has a rounded end that has a corresponding elongated opening 172 and 174, respectively.

Figure 3:
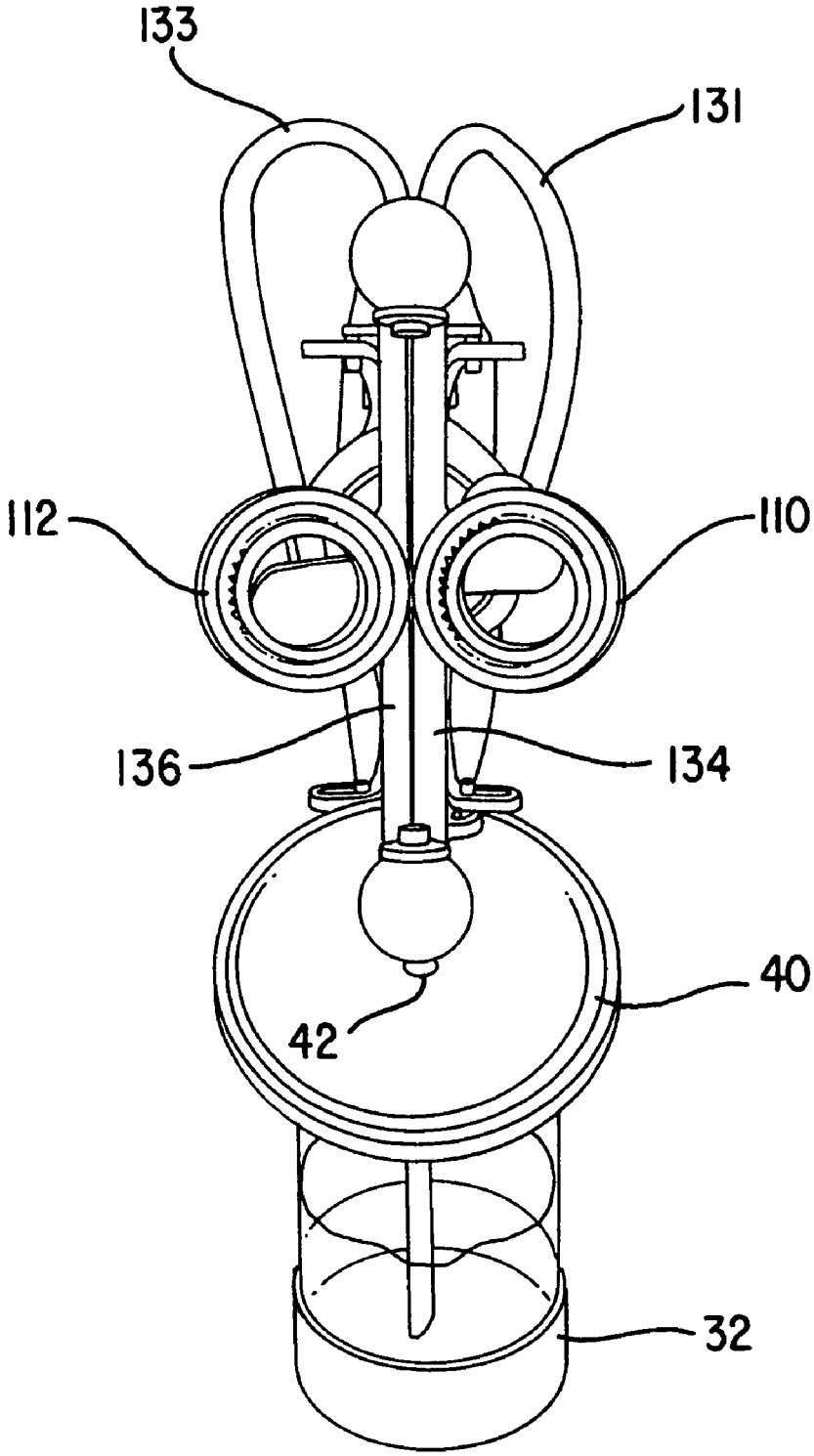
FIG. 3 is a front view of the assembly of FIG. 1 shown with the two bubble rings positioned side by side with each other.

As best seen in FIGS. 3 and 6, the ring supports 134 and 136 are elongated shafts that are positioned adjacent and parallel to each other along their inner sides. The ring 110 is attached to the center of, and along the outer side of, the ring support 134. Similarly, the ring 112 is attached to the center of, and along the outer side of, the ring support 136. Thus, the two rings 110, 112 extend away from the ring supports 134, 136, but are essentially positioned side-by-side to each other so that one ring 110 can be pivoted to completely cover the other ring 112, and vice versa. An upper rounded opening 188 is provided in an extension 190 that extends from the top of the ring support 134 at an orientation that is perpendicular to the ring support 134, and a lower rounded opening 192 is provided in another extension 194 that extends from the bottom of the ring support 134 at an orientation that is perpendicular to the ring support 134. Protrusions 196 and 198 are provided adjacent the openings 188 and 192, respectively, in the extensions 190 and 194, respectively, and extend towards each other in a direction parallel to the ring support 134. Similarly, an upper rounded opening 200 is provided in an extension 202 that extends from the top of the ring support 136 at an orientation that is perpendicular to the ring support 136, and a lower rounded opening 204 is provided in another extension 206 that extends from the bottom of the ring support 136 at an orientation that is perpendicular to the ring support 136. Protrusions 208 and 210 are provided adjacent the openings 200 and 204, respectively, in the extensions 202 and 206, respectively, and extend towards each other in a direction parallel to the ring support 136. An upper pivot shaft 216 extends through the upper openings 188 and 200 of the ring supports 134 and 136, respectively, and a lower pivot shaft 218 extends through the lower openings 192 and 204 of the ring supports 134 and 136, respectively, so that the two ring supports 134 and 136 can pivot with respect to each other about a pivot axis defined by the pivot shafts 216 and 218. The pivot shafts 216 and 218 are pivotably secured to fixed locations 240 and 242, respectively, of the housing 22. In addition, the protrusions 196 and 208 are retained in the openings 162 and 164, respectively, so that the upper ends of the ring supports 134 and 136 are coupled for pivoting movement with respect to the upper section 146 of the U-shaped bar 132. Similarly, the protrusions 198 and 210 are retained in the openings 172 and 174, respectively, so that the lower ends of the ring supports 134 and 136 are coupled for pivoting movement with respect to the lower section 148 of the U-shaped bar 132. The protrusions 196+208, the protrusions 198+210, and the pivot shafts 216, 218 experience independent circular motion with respect to each other.

Figure 12:
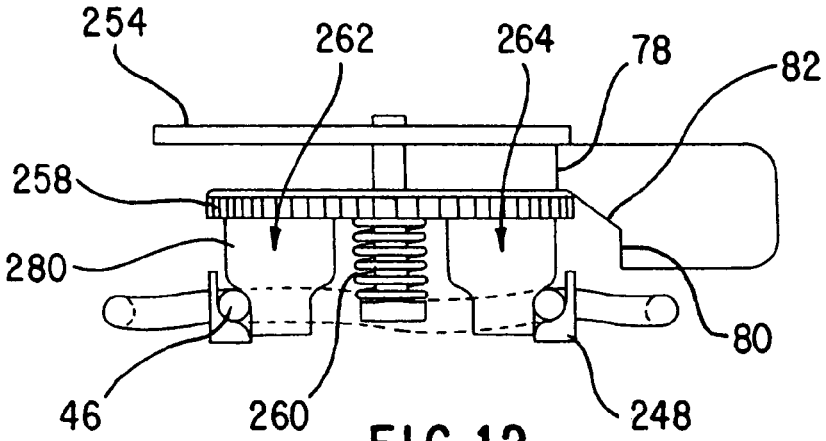
FIG. 12 is an isolated top plan view illustrating the relationship between the pressure rollers and the tube when the assembly of FIG. 1 is in the normal non-operational condition.
Figure 13:
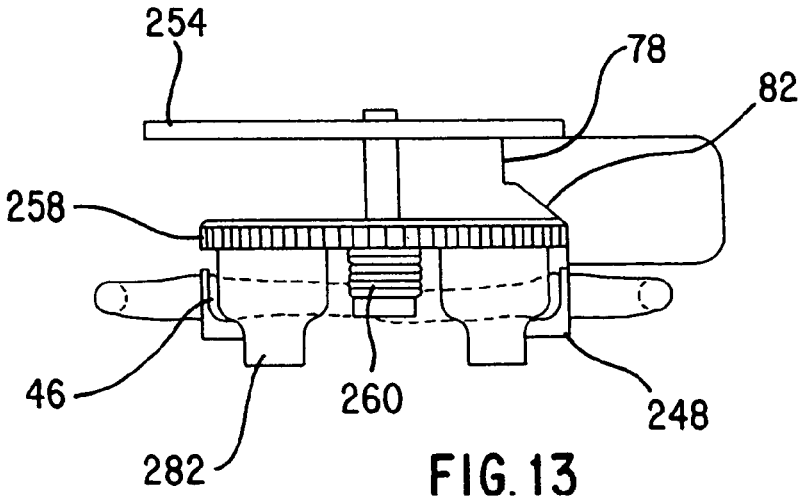
FIG. 13 is an isolated top plan view illustrating the relationship between the pressure rollers and the tube when the assembly of FIG. 1 is in the bubble-generating position.

Referring now to FIGS. 4–6 and 12–13, the assembly 20 includes a pump system that functions to pump the bubble solution from the solution bottle 32 to the bubble rings 110, 112. The pump system includes the motor 50, the tube 46, the tubings 131, 133, a guide wall 248, and a gear system that functions to draw bubble solution through the tube 46 and tubings 131, 133. The gear system includes a motor gear 250 that is rotatably coupled to a shaft 252 of the motor 50, a gear housing plate 254, a first gear 256, a second gear 258, a resilient element 260 (such as a spring), two pressure rollers 262, 264, and a shaft 266. The motor gear 250 has teeth that are engaged with the teeth of the first gear 256. The first gear 256 is rotatably coupled to the gear housing plate 254, and has teeth that are engaged with the teeth of the second gear 258. The second gear 258 rotates about an axis defined by the shaft 266, and the resilient element 260 is carried on the shaft 266 between the second gear 258 and an enlarged end of the shaft 266. The pressure rollers 262, 264 are spaced apart along the outer periphery of the second gear 258 and positioned to face away from the gear housing plate 254. Referring also to FIGS. 12 and 13, each pressure roller 262, 264 has a base section 280 and an upper section 282 which has a smaller diameter than the diameter of the base section 280. The gear housing plate 254 has an opening 268 along one side through which a guide element 270 (e.g., a screw) is fitted. The second gear 258 is positioned adjacent the push button 66, with a portion of the stepped extension 76 of the push button 66 extending into the path of the tube 46 between the second gear 258 and the gear housing plate 254 (see FIGS. 12 and 13). In particular, the tube 46 extends from the interior of the solution bottle 32, through the opening 44 in the solution dish 40, into the housing 22, and passes through a path (that is defined by the guide element 270, the pressure rollers 262, 264, and the guide wall 248) that leads to a branch 272 from where the tubings 131, 133 extend. At the location of the guide element 270, the pressure rollers 262, 264, and the guide wall 248, the tube 46 is positioned between the second gear 258 and the guide wall 248.

The pump system operates in the following manner. When the motor 50 is actuated, the motor gear 250 will rotate, thereby causing the first and second gears 256 and 258 to rotate as well. As the second gear 258 rotates, the pressure rollers 262, 264 will rotate as well. As the pressure rollers 262, 264 rotate, they will apply selected pressure on different parts of the tube 46 in the manner described below.

Figure 4:
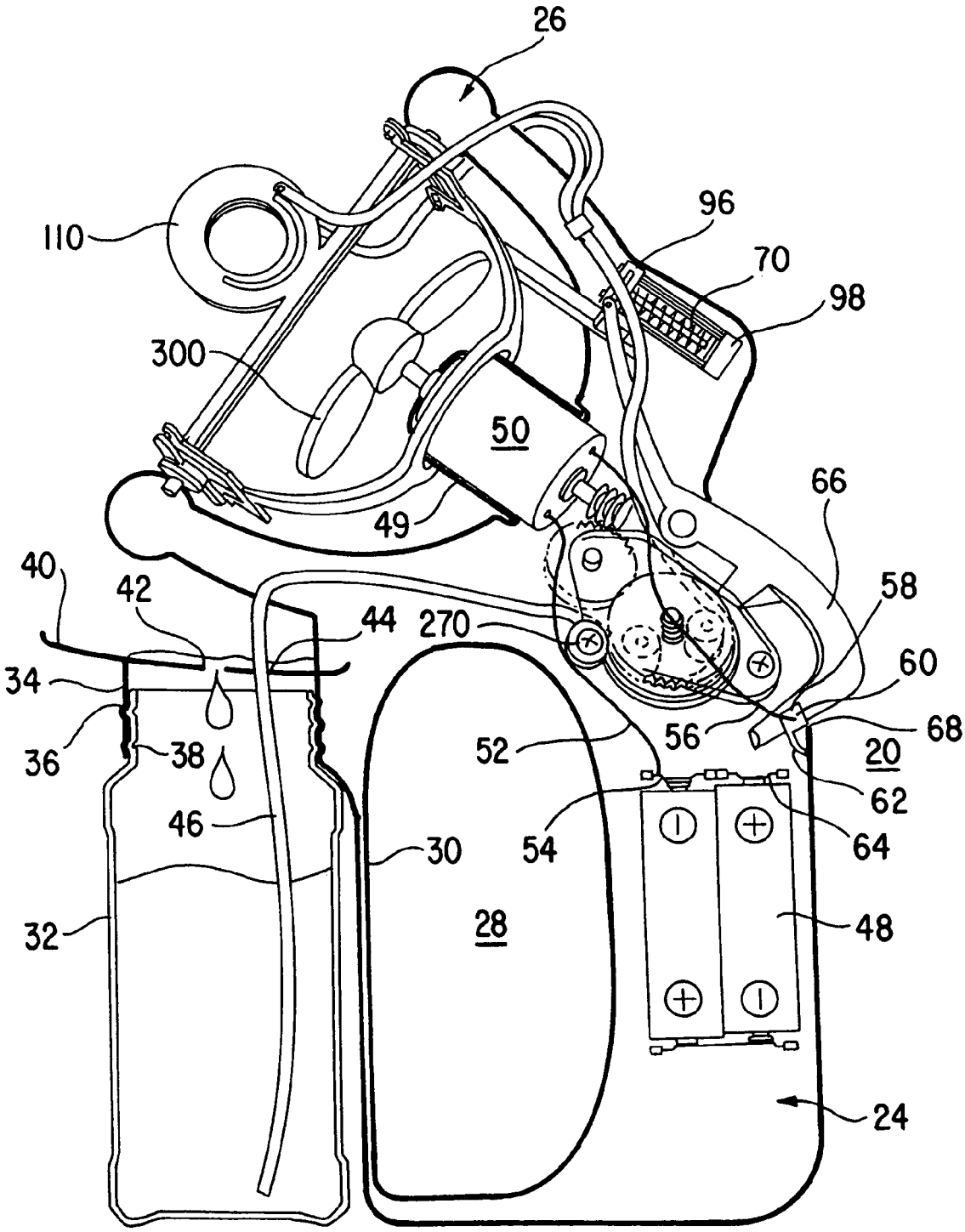
FIG. 4 is a cross-sectional view of the assembly of FIG. 1 shown with the two bubble rings contacting each other.
Figure 8:
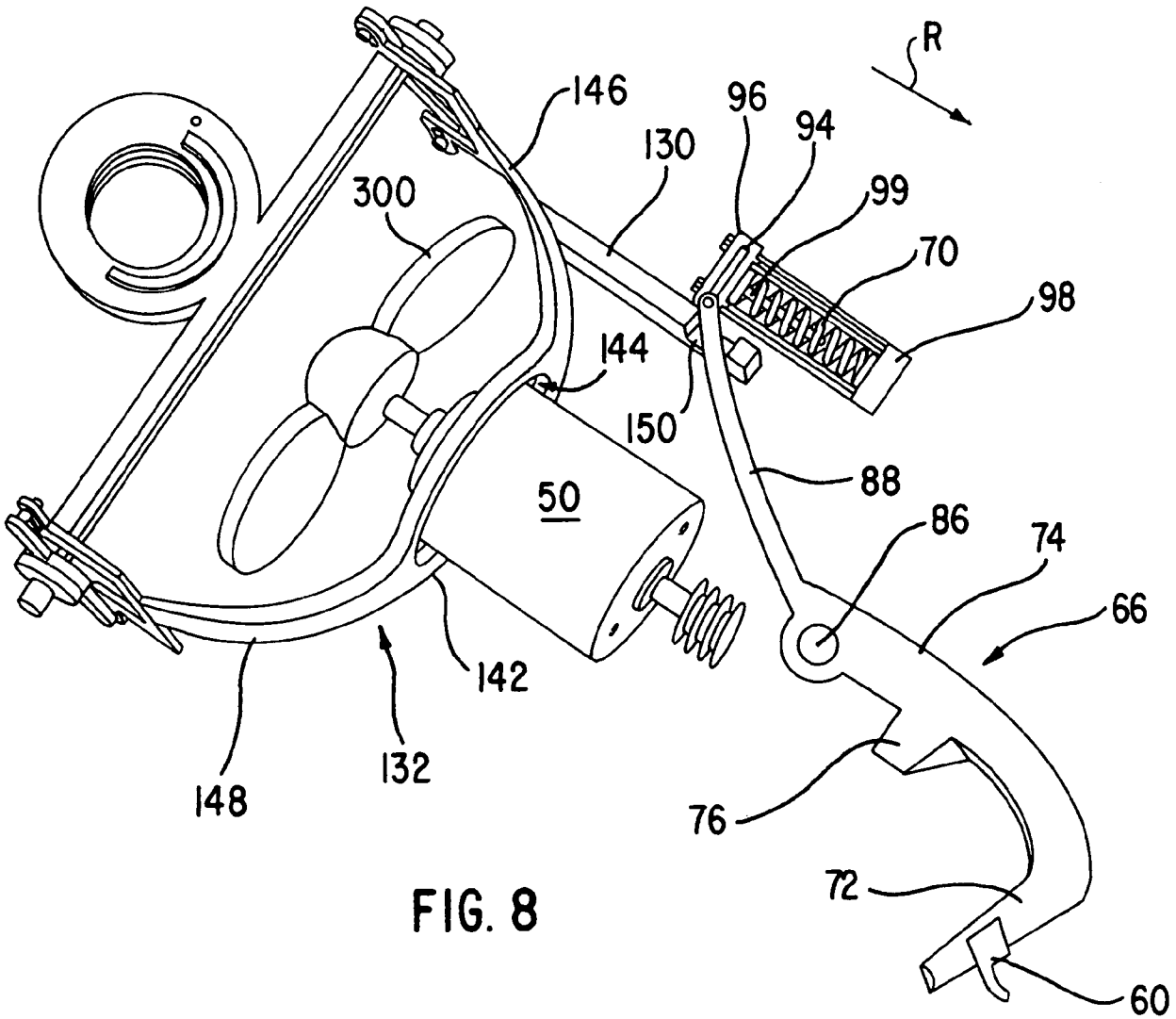
FIG. 8 is an isolated and enlarged perspective view of the link system of the assembly of FIG. 1 shown with the two bubble rings contacting each other.

The assembly 20 operates in the following manner. In the normal non-operational condition (i.e., when the rings 110, 112 are contacting each other in the closed position as shown in FIGS. 1, 4 and 8), the push button 66 is normally biased outwardly away from the housing 22 by the resilient element 70 (as explained above). When the user presses the push button 66 (see FIGS. 2, 5 and 9), the push button 66 pivots clockwise about the shaft 86 (in the orientation shown in FIGS. 4 and 5), which causes three sequences of events occur at about the same time.

First, the bubble rings 110, 112 are moved from their closed position to their opened position. As best shown by comparing FIGS. 8 and 9, the bar 88 of the push button 66 is pivoted in a clockwise direction so that the sliding shaft 92 is pushed upwardly within the groove 94. The upward movement of the sliding shaft 92 pushes the locking piece 96 rearwardly along the locking rack 98 in the direction of arrow R, thereby overcoming the normal bias of the resilient element 70. As the bar 88 is pivoted in the clockwise direction, the bar 88 pulls the control bar 130 rearwardly in the direction of arrow R because the bar 88 is seated inside the groove 150 of the control bar 130. Rearward movement of the control bar 130 will pull the U-shaped pivoting bar 132 rearwardly in the direction of arrow R. Since the pivot axis defined by the pivot shafts 216 and 218 is fixed, rearward movement of the pivoting bar 132 will cause the ring supports 134 and 136 to pivot about the pivot axis defined by the pivot shafts 216, 218 when the protrusions 196, 198, 208, 210 slide back and forth within the elongated openings 162, 172, 164, 174, respectively (see FIGS. 10 and 11), so as to pivot the ring supports 134, 136 (and their bubble rings 110, 112) from the closed position to the opened position, where the openings of the bubble rings 110, 112 (and the formed films of bubble solution) will be directly facing an air generator 300.

Figure 10:
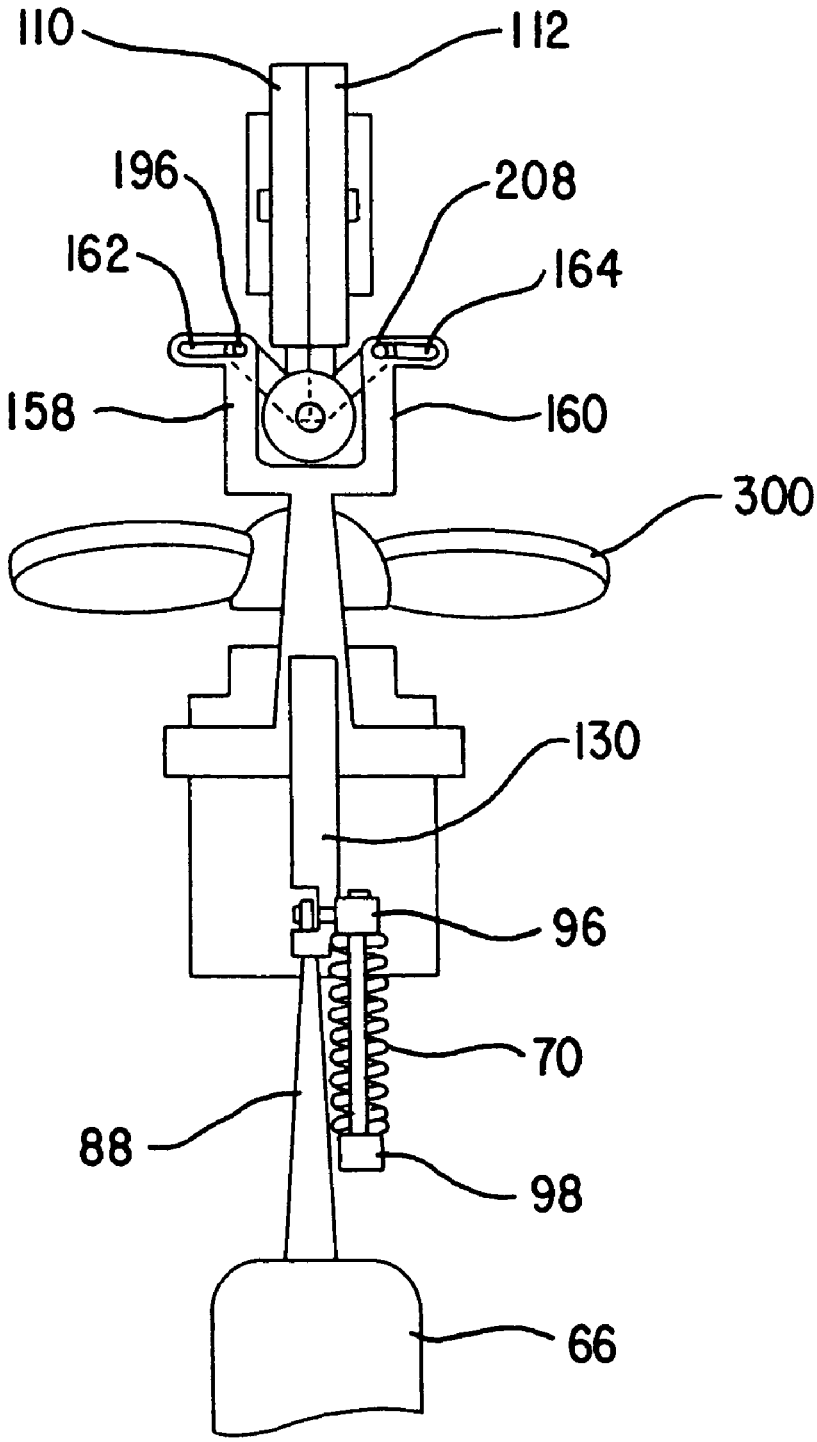
FIG. 10 is an isolated and top plan view of the link system of the assembly of FIG. 1 shown with the two bubble rings contacting each other.
Figure 11:
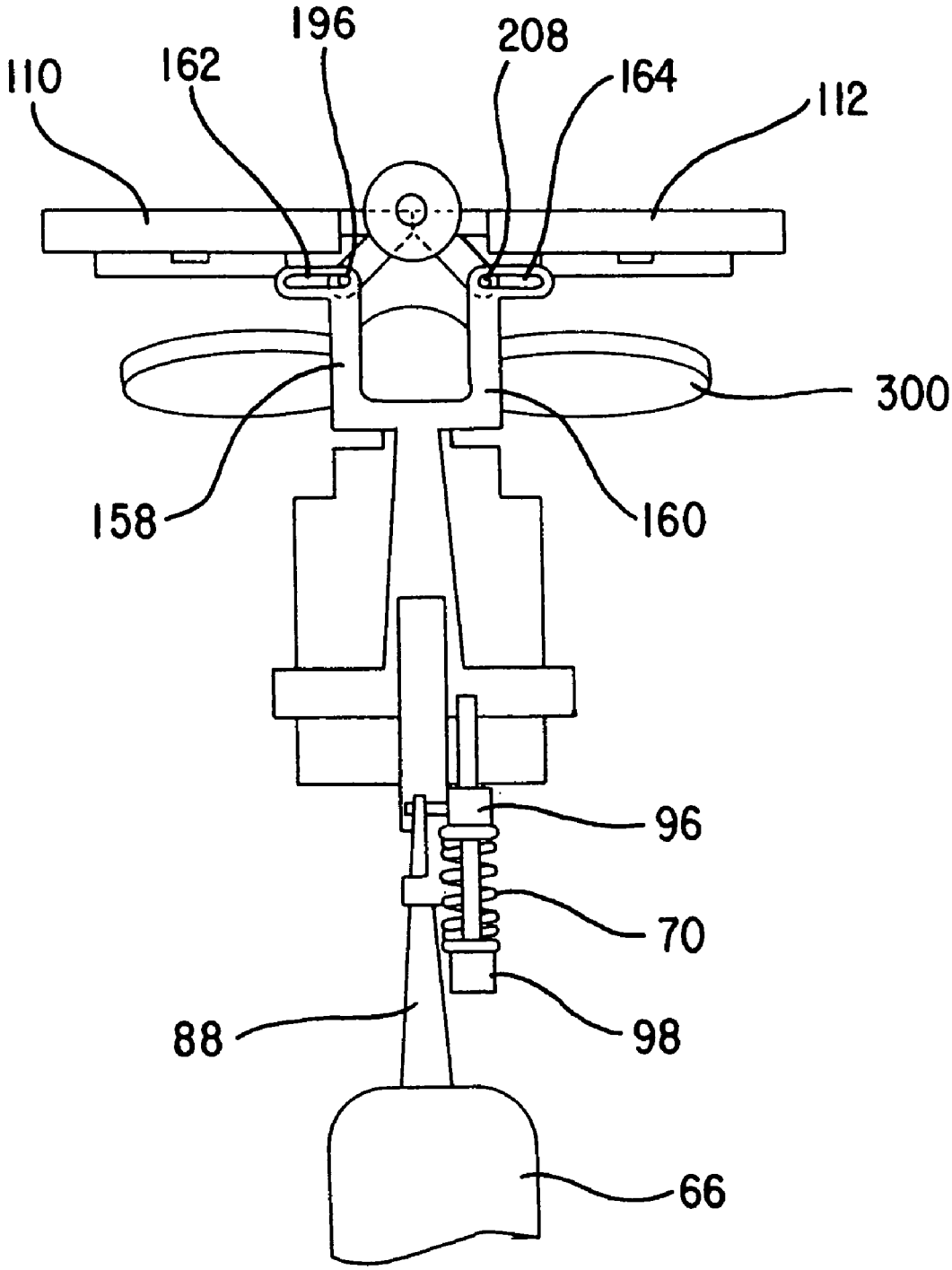
FIG. 11 is an isolated and top plan view of the link system of the assembly of FIG. 1 shown with the two bubble rings positioned side by side with each other.

The back and forth sliding motion of the protrusions 196, 198, 208, 210 within the elongated openings 162, 172, 164, 174, respectively, can be described as follows: when the two rings 110, 112 contact each other in the position shown in FIG. 10, the protrusions 196, 198, 208, 210 are positioned at the inner ends of a respective elongated opening 162, 172, 164, 174. As the pivoting bar 132 causes the ring supports 134 and 136 to pivot about the pivot axis defined by the pivot shafts 216, 218, the rings 110, 112 will move apart from each other. As the rings 110, 112 move apart from each other, the protrusions 196, 198, 208, 210 will slide from the inner ends to the outer ends of the respective elongated opening 162, 172, 164, 174. When the protrusions 196, 198, 208, 210 reach the outer ends of the respective elongated opening 162, 172, 164, 174, the rings 110, 112 will be about ninety degrees apart from other, and further pivoting by the ring supports 134, 136 will cause the protrusions 196, 198, 208, 210 will slide from the outer ends to the inner ends of the respective elongated opening 162, 172, 164, 174. When the protrusions 196, 198, 208, 210 reach the inner ends of the respective elongated opening 162, 172, 164, 174 again, the rings 110, 112 will be about one hundred and eighty degrees apart from other, as shown in FIG. 11.

Figure 2:
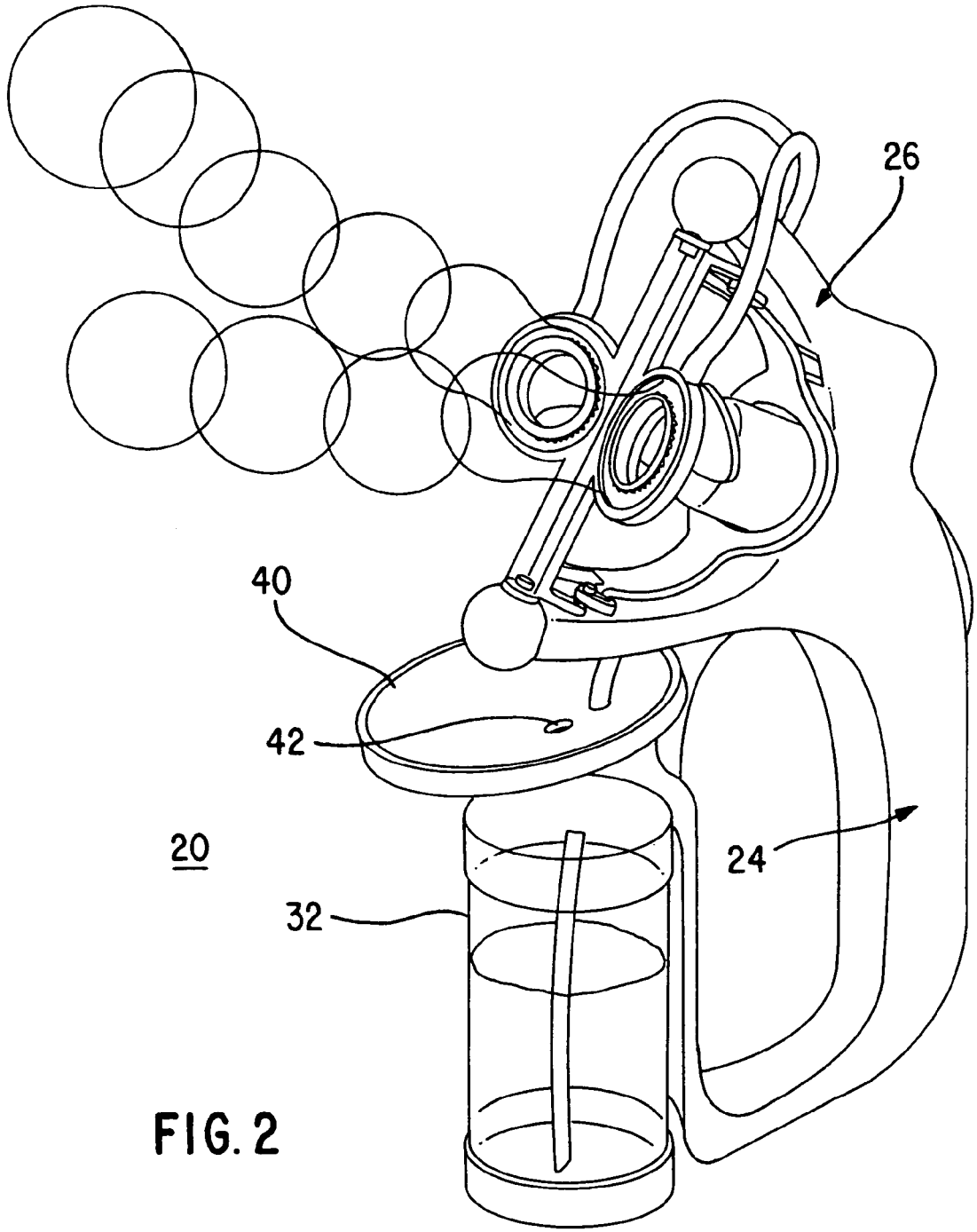
FIG. 2 is another perspective view of the assembly of FIG. 1 shown with the two bubble rings positioned side by side with each other.
Figure 9:
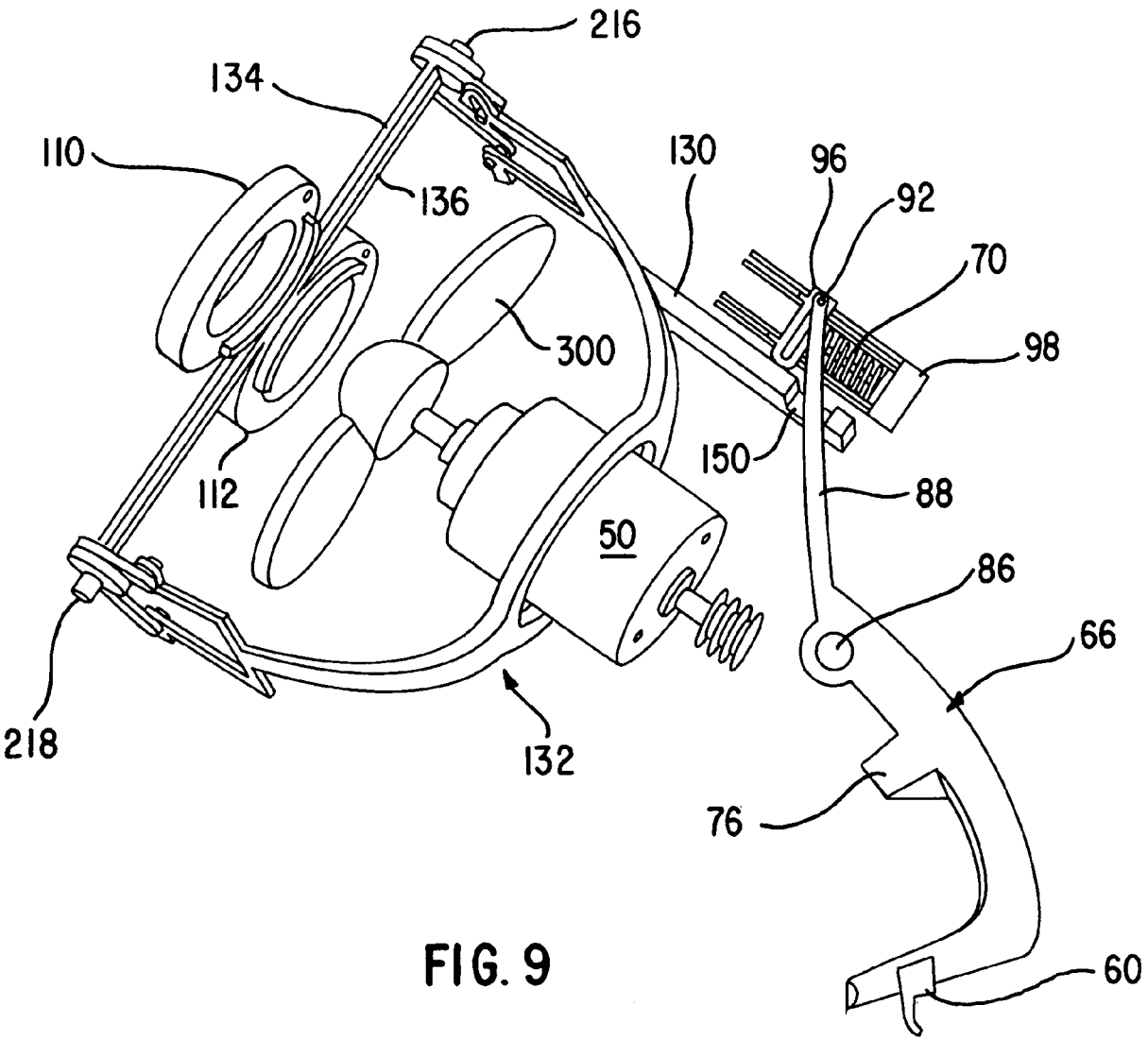
FIG. 9 is an isolated and enlarged perspective view of the link system of the assembly of FIG. 1 shown with the two bubble rings positioned side by side with each other.

Second, bubble solution is pumped to the bubble rings 110, 112. In this regard, the clockwise pivot of the push button 66 causes the second contact 60 to engage the third contact 64, thereby forming a closed electrical circuit that will deliver power from the power source 48 to the motor 50. The motor 50 will turn on, thereby causing the motor gear 250 to drive and rotate the first and second gears 256 and 258. As the pressure rollers 262, 264 on the second gear 258 rotate, they will apply selected pressure on different parts of the tube 46. FIGS. 12 and 13 illustrate this in greater detail. FIG. 12 illustrates the relationship between the pressure rollers 262, 264 and the tube 46 when the assembly 20 is in the normal non-operational condition (i.e., when the rings 110, 112 are contacting each other in the closed position as shown in FIGS. 1, 4 and 8), and FIG. 13 illustrates the relationship between the pressure rollers 262, 264 and the tube 46 when the assembly 20 is in the bubble-generating position (i.e., when the rings 110, 112 are side-by-side in the opened position as shown in FIGS. 2, 5 and 9). As shown in FIG. 12, the tube 46 is normally fitted between the smaller-diameter upper section 282 of the pressure rollers 262, 264 and the guide wall 248, and the lower edge 78 of the stepped extension 76 of the push button 66 is fitted between the second gear 258 and the gear housing plate 254. The resilient element 260 normally biases the second gear 258 towards the gear housing plate 254. When the push button 66 is pressed and pivoted, the stepped extension 76 is pressed inside the space between the second gear 258 and the gear housing plate 254, overcoming the normal bias of the resilient element 260 and causing the second gear 258 to slide along the angled edge 82 to increase the distance between the second gear 258 and the gear housing plate 254. As the second gear 258 moves away from the gear housing plate 254 towards the guide wall 248, the pressure rollers 262, 264 are pushed into the tube 46 so that the tube 46 is now positioned between the guide wall 248 and the larger-diameter base section 280 of the pressure rollers 262, 264, thereby compressing the tube 46 as shown in FIG. 13. Thus, rotation of the pressure rollers 262, 264 will compress different portions of the tube 46, thereby creating air pressure to draw the bubble solution from the interior of the solution bottle 32 through the tube 46, on to the tubings 131 and 133, and then into the chambers 118 of the bubble rings 110, 112, where the bubble solution will bleed out through the outlets 124 on to the front surfaces 126 of the bubble rings 110, 112.

This arrangement and structure of the pressure rollers 262, 264 is effective in prolonging the useful life of the tube 46 and the pump system. In particular, the pressure rollers 262, 264 only apply pressure against the tube 46 when the push button 66 is actuated (i.e., the larger-diameter base section 280 only compresses the tube 46 when the push button 66 is pressed), so that the tube 46 does not experience any pressure when the push button 66 is not actuated (i.e., the smaller-diameter upper section 282 is positioned adjacent to, but does not compress, the tube 46 when the push button 66 is not pressed). This is to be contrasted with conventional pump systems used for pumping bubble solution to a bubble producing device, where pressure is always applied to the tube regardless of whether the trigger or button is actuated. Over a long period of time, this constant pressure will deform the tube, making it difficult for bubble solution to be drawn through the tube.

Third, the air generator 300 (such as a fan which extends outside the housing 22) that is secured to the motor 50 is actuated when the motor 50 is turned on. In this regard, the clockwise pivot of the push button 66 causes the second contact 60 to engage the third contact 64, thereby forming a closed electrical circuit that will deliver power from the power source 48 to the motor 50 to rotate the air generator 300. The air generator 300 blows a stream of air towards the bubble rings 110, 112. This stream of air will then travel through the film of bubble solution that have been formed over the bubble rings 110, 112, thereby creating bubbles.

Thus, pressing the push button 66 will actuate the air generator 300, and will cause the bubble rings 110, 112 to be positioned side-by-side to face the air generator 300 so that bubbles can be created. Pressing the push button 66 will also pump bubble solution from the solution bottle 32 to the bubble rings 110, 112.

When the user releases his or her pressing grip on the push button 66, the resilient element 70 will normally bias the locking piece 96 towards the front end 100 of the locking rack 98, thereby pivoting the push button 66 in a counter-clockwise direction (as viewed from the orientation of FIGS. 4 and 5) about the pivot shaft 86, biasing the push button 66 outwardly away from the housing 22. This will cause the second contact 60 carried on the push button 66 to be biased away from the third contact 64 so that power to the motor 50 is cut. As a result, the air generator 300 will stop producing streams of air, and the pump system will stop drawing bubble solution from the solution bottle 32 to the bubble rings 110, 112. In addition, the bar 88 will push the control bar 130 in a forward direction (opposite to the direction of arrow R), thereby pushing the U-shaped pivoting bar 132 forwardly as well. Since the pivot axis defined by the pivot shafts 216 and 218 are fixed, forward movement of the pivoting bar 132 will cause the ring supports 134 and 136 to pivot about the pivot axes defined by the protrusions 196+198 and 208+210 (in a reverse manner from that described above for the back and forth motion of the protrusions 196, 198, 208, 210 within the elongated openings 162, 172, 164, 174, respectively), so as to pivot the ring supports 134, 136 (and their bubble rings 110, 112) from the opened position of FIGS. 2, 5 and 9 to the closed position of FIGS. 1, 4 and 8.

In addition, as best shown in FIGS. 4 and 5, the solution dish 40 is positioned directly below the bubble rings 110, 112 to collect any stray droplets of bubble solution that drip from the bubble rings 110, 112. These stray droplets can flow back into the solution bottle 32 via the opening 42. In addition, the solution bottle 32 can be removed from the housing 22 by threadably disengaging the neck of the solution bottle 32 from the connecting section 34.

Figure 14:
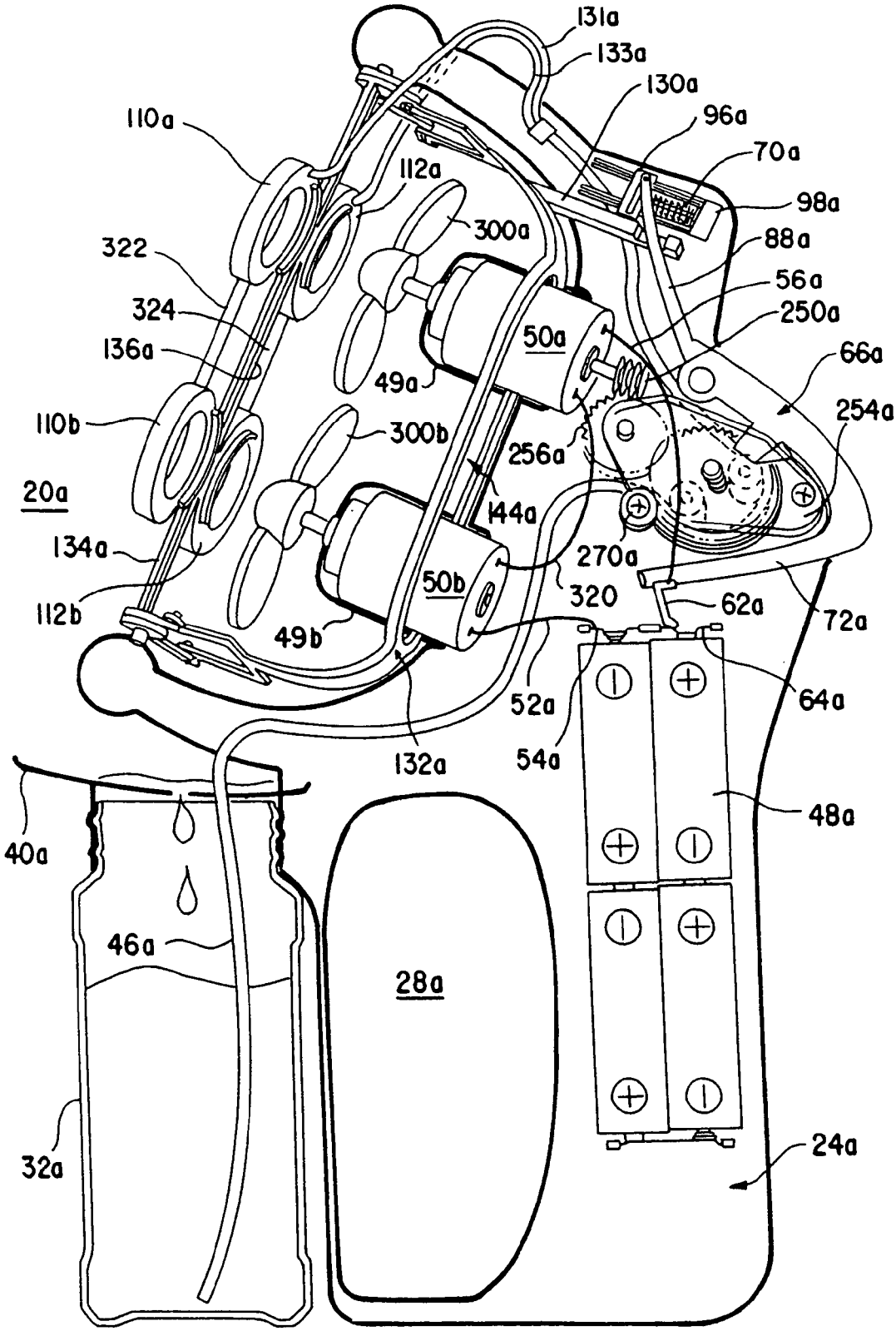
FIG. 14 is a cross-sectional view of a bubble generating assembly according to another embodiment of the present invention shown with the two sets of bubble rings positioned side by side with each other.

FIG. 14 illustrates another bubble generating assembly 20*a* according to the present invention. The assembly 20*a* differs from the assembly 20 of FIGS. 1–13 in that two sets of two bubble rings 110*a*+110*b* and 112*a*+112*b* are provided instead of just two bubble rings 110, 112. For this reason, most of the elements in the assembly 20*a* of FIG. 14 are identical to the same elements in the assembly 20 of FIGS. 1–13, and will not be described herein. The elements in the assemblies 20 and 20*a* that are identical will be designated by the same numeral designations, except that an "a" will be added to the designations in FIG. 14. The following description will only highlight the differences between the assemblies 20 and 20*a*.

The assembly 20*a* differs from the assembly 20 of FIGS. 1–13 in that two sets of two bubble rings 110*a*+110*b* and 112*a*+112*b* are provided instead of just two bubble rings 110, 112. To facilitate this modification, two motors 50*a* and 50*b* are provided and are retained inside the opening 144*a* (which is now elongated to accommodate the two motors 50*a*, 50*b*) in the pivoting bar 132*a*. In addition to the wires 52*a* and 56*a* (which are the same as the wires 52 and 56 in FIGS. 1–13), an additional wire 320 couples the two motors 50*a* and 50*b*. Each motor 50*a* and 50*b* carries a separate air generator 300*a* and 300*b*, respectively. Each ring support 134*a* and 136*a* now carries two bubble rings 110*a*+110*b* and 112*a*+112*b*, respectively. The bubble rings 110*a* and 110*b* are both attached to the outer side of the ring support 134*a*, and are spaced apart by a delivery tube 322. Each opposing end of the delivery tube 322 can be connected to a peripheral opening in the annular base piece (e.g., 114) of a separate bubble ring 110*a* and 110*b*. As a result, the bubble solution that has entered the annular chamber (e.g., 118) of the upper bubble ring 110*a* can flow through the delivery tube 322 into the annular chamber (e.g., 118) of the lower bubble ring 110*b*. Similarly, the bubble rings 112*a* and 112*b* are both attached to the outer side of the ring support 136*a*, and are spaced apart by another delivery tube 324. Each opposing end of the delivery tube 324 can be connected to a peripheral opening in the annular base piece (e.g., 114) of a separate bubble ring 112*a* and 112*b*. As a result, the bubble solution that has entered the annular chamber (e.g., 118) of the upper bubble ring 112*a* can flow through the delivery tube 324 into the annular chamber (e.g., 118) of the lower bubble ring 112*b*.

The assembly 20*a* operates in the same manner as the assembly 20. The only difference is that the additional bubble rings 110*b*, 112*b* will generate more bubbles.

Figure 15:
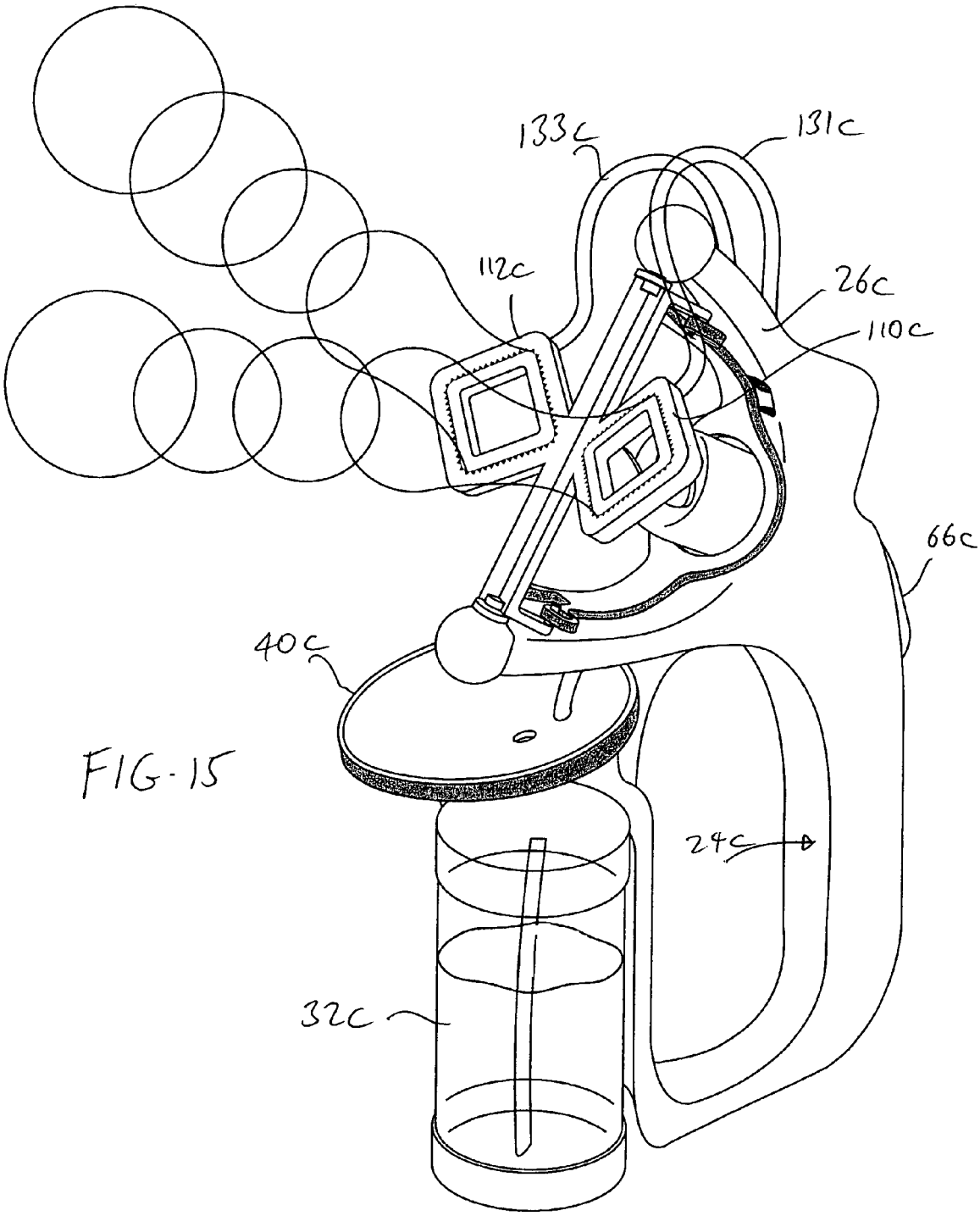
FIG. 15 is a cross-sectional view of a bubble generating assembly according to yet another embodiment of the present invention.
Figure 17:
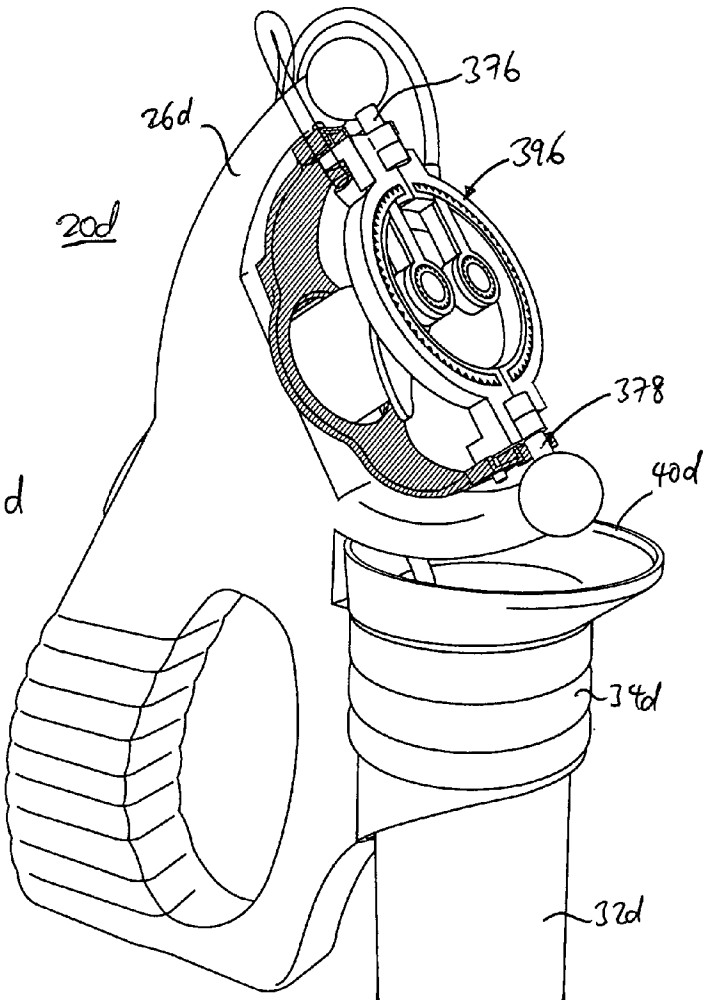
FIG. 17 is another perspective view of the assembly of FIG. 16 shown with the bubble rings in the opened position.
Figure 16:
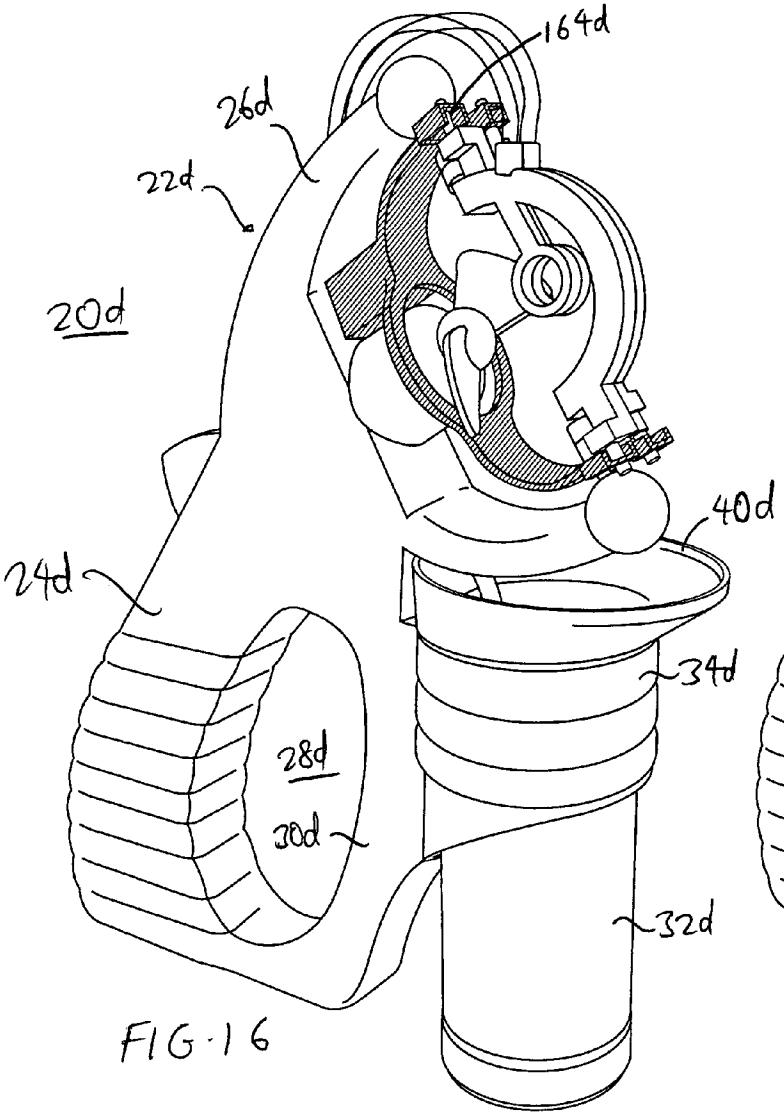
FIG. 16 is a perspective view of a bubble generating assembly according to a further embodiment of the present invention shown with the bubble rings in the closed position.
Figure 18:
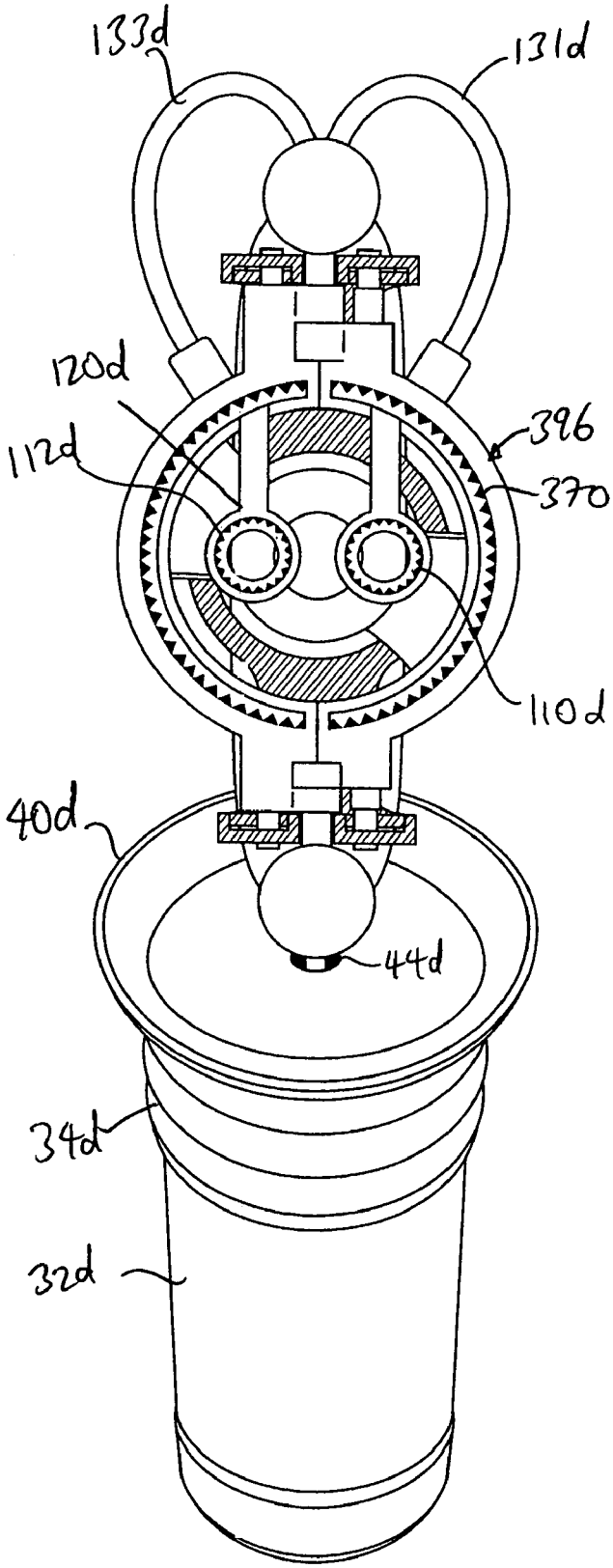
FIG. 18 is a front view of the assembly of FIG. 16 shown with the bubble rings positioned side by side with each other.
Figure 20:
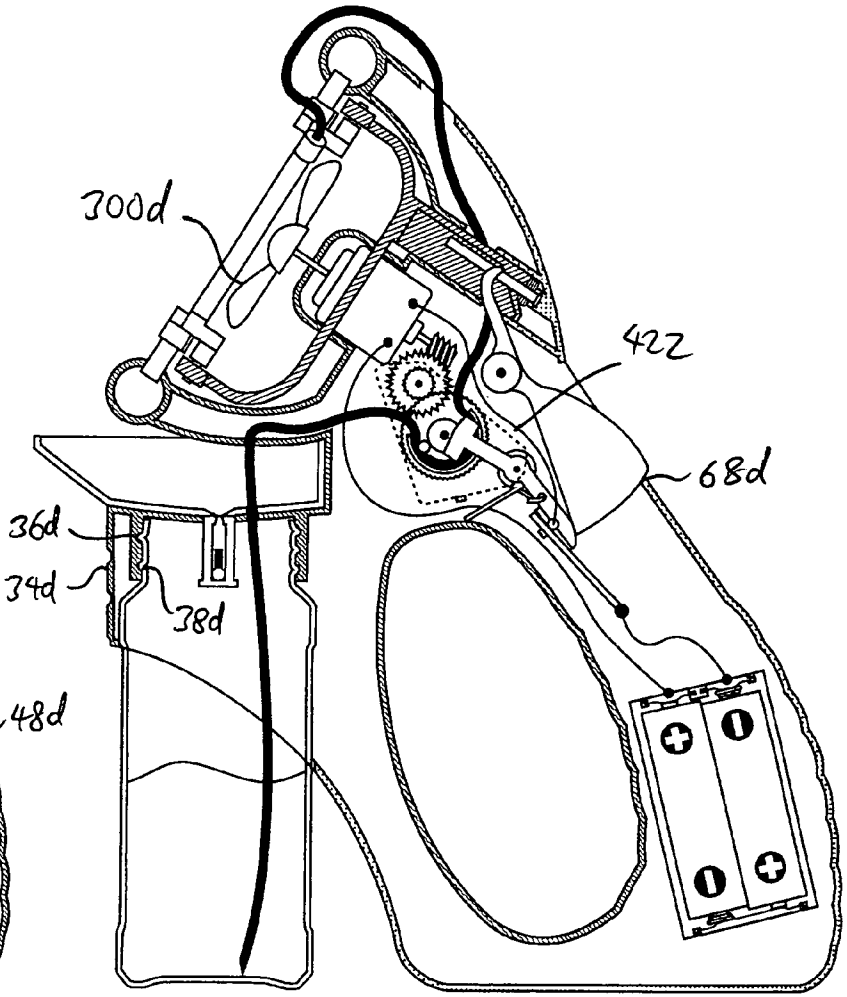
FIG. 20 is a cross-sectional view of the assembly of FIG. 16 shown with the bubble rings in the opened position.
Figure 19:
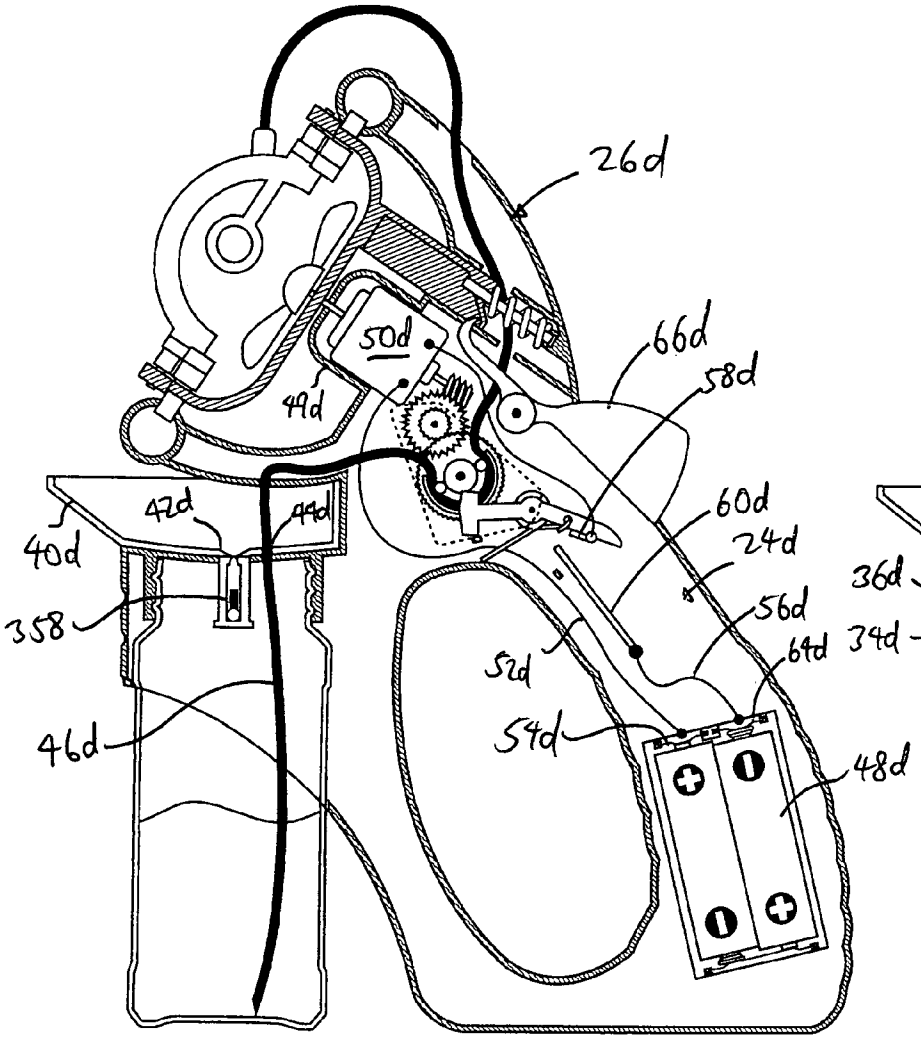
FIG. 19 is a cross-sectional view of the assembly of FIG. 16 shown with the bubble rings in the closed position.

FIG. 15 illustrates another bubble generating assembly 20*c* according to the present invention. The assembly 20*c* differs from the assembly 20 of FIGS. 1–13 in that the bubble rings 110*c* and 112*c* have a diamond shape instead of the circular shape shown in FIGS. 1–13. The bubble rings 110*c*, 112*c* have four discrete sides that are connected together to form a four-sided bubble ring, which can be diamond-shaped (as shown in FIG. 15) or rectangular or square. Similarly, the bubble rings 110*c* and 110*d* can be provided in a triangular configuration. All of the other elements in the assembly 20*c* of FIG. 15 are identical to the same elements in the assembly 20 of FIGS. 1–13, and will not be described herein. The elements in the assemblies 20 and 20*c* that are identical will be designated by the same numeral designations, except that a "c" is added to the designations in FIG. 15.

FIGS. 16–28 illustrates another bubble generating assembly 20*d* according to the present invention. The assembly 20*d* differs from the assembly 20 of FIGS. 1–13 in that an outer bubble ring 396 is provided in addition to the two bubble rings 110*d* and 112*d*, which are positioned inside the outer bubble ring 396. For this reason, most of the elements in the assembly 20*d* of FIGS. 16–28 are identical to the same elements in the assembly 20 of FIGS. 1–13, and will not be described herein. The elements in the assemblies 20 and 20*d* that are either similar or identical will be designated by the same numeral designations, except that a "d" will be added to the designations in FIGS. 16–28. The following description will only highlight the differences between the assemblies 20 and 20*d*.

Here, it should be noted that although the term "ring" is used to describe elements 110, 110*c*, 110*d*, 112, 112*c*, 112*d*, these "rings" are essentially a frame for a bubble generating device.

Starting with FIGS. 16–20, the assembly 20*d* has a housing 22*d* that includes a bottom or handle section 24*d* and an upper or bubble generating section 26*d*. The housing 22*d* can be provided in the form of two symmetrical outer shells that are connected together by, for example, screws or welding or glue. These outer shells together define a hollow interior for housing the internal components of the assembly 20*d*, as described below. The handle section 24*d* has an opening 28*d* through which a user can extend his or her fingers to grip the handle section 24*d*. The front wall 30*d* of the opening 28*d* defines a shielding wall against which a conventional bubble solution bottle 32*d* can be rested. A connecting section 34*d*, which resembles an annular wall, extends from the front of the top of the front wall 30*d*, and has internal threads 36*d* (see FIGS. 19 and 20) that are adapted to releasably engage the external threads 38*d* on the neck of the solution bottle 32*d*. A solution dish 40*d* is secured to the top of the connecting section 34*d*, and has a first opening 42*d* that communicates with the interior of the connecting section 34*d*. The dish 40*d* also has a second opening 44*d* that communicates with the interior of the connecting section 34*d*, and which receives a tube 46*d* that extends therethrough from the solution bottle 32*d* to the bubble generating section 26*d*. A valve 358 can be coupled to the first opening 42*d* to prevent the flow of bubble solution from the solution bottle 32*d* to the dish 40*d*.

The handle section 24*d* houses a power source 48*d* which can include at least one conventional battery. The bubble generating section 26*d* has a motor housing 49*d* that houses a motor 50*d* that is electrically coupled to the power source 48*d* via a first wire 52*d* and a first electrical contact 54*d*. A second wire 56*d* couples a second electrical contact 60*d* to a third electrical contact 64*d* that is coupled to the power supply 48*d*. The second contact 60*d* is adapted to removably couple a fourth electrical contact 58*d* that is positioned on a pivoting pusher 398. A third wire 422 couples the motor 50*d* to the fourth contact 58*d*.

Referring also to FIGS. 21–22 and 29–33, the pusher 398 is an elongated member that pivots about a pivot axis that is defined by a pivot shaft 418, and has pushing end 424 that is configured like a hammer-head. The pushing end 424 extends from one end of the pusher 398, and has a thickness which gradually decreases (e.g., in a linear manner) along a ramped surface 426. Specifically, the pusher 398 has two opposing flat surfaces 428 and 430 that are parallel to each other so that the thickness of the pushing end 424 between these two opposing surfaces 428, 430 is the same. One of the flat surfaces 430 terminates short of one end and transitions to a ramped surface 426 that gradually decreases the thickness of the pushing end 424. A resilient element 420 (e.g., a spring) is provided adjacent the pivot axis 418 to normally bias the pusher 398 in a counter-clockwise direction as viewed from the orientation of FIGS. 19 and 20.

Figure 21:
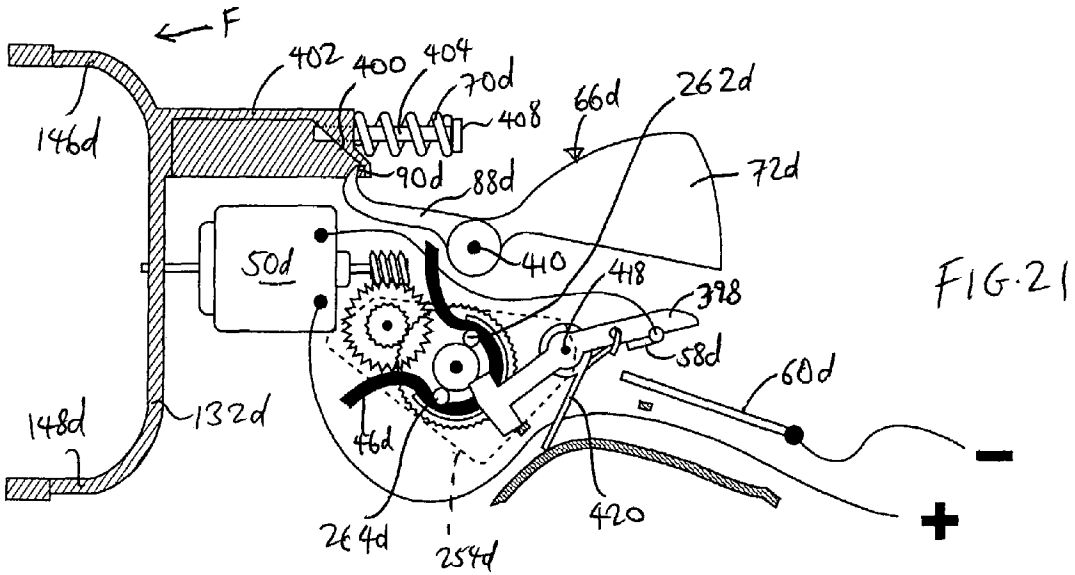
FIG. 21 is an isolated and enlarged perspective view of the link system of the assembly of FIG. 16 when the bubble rings are in the closed position.
Figure 22:
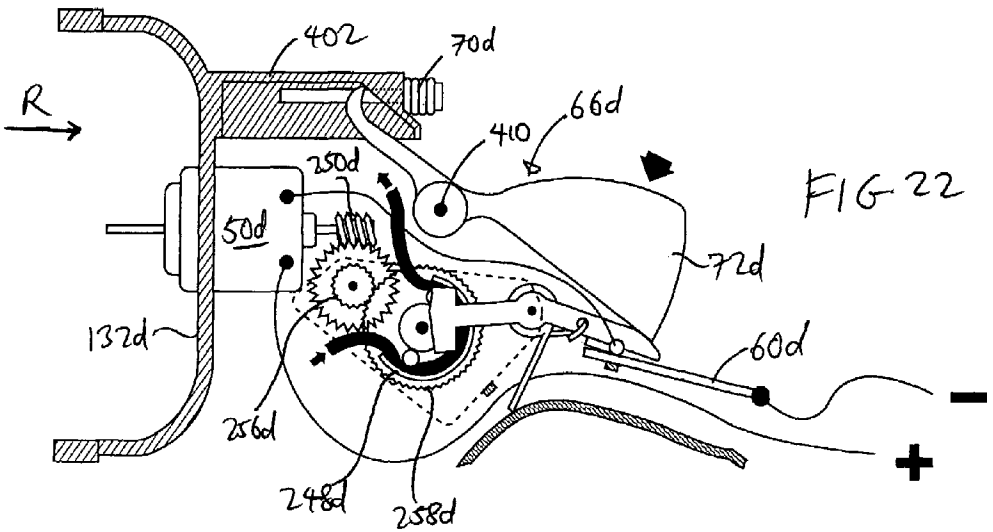
FIG. 22 is an isolated and enlarged perspective view of the link system of the assembly of FIG. 16 when the bubble rings are in the opened position.
Figure 23:
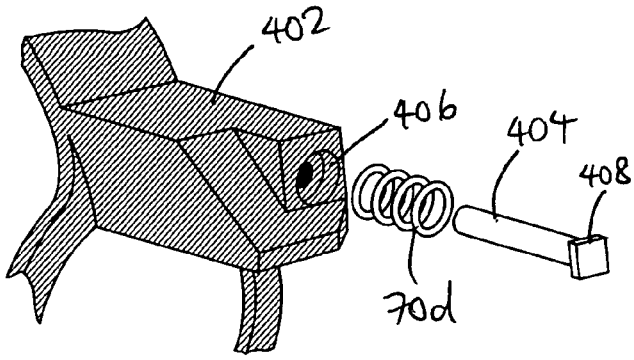
FIG. 23 is an enlarged exploded view of the frame and resilient member of the link system of the assembly of FIG. 16.

A push button 66*d* is positioned at a rear side of the housing 22*d* between the handle section 24*d* and the bubble generating section 26*d*, and extends through an opening 68*d* in the housing 22*d*. Referring also to FIGS. 21–22, the push button 66*d* has an enlarged pushing region 72*d* and a curved bar 88*d*. The terminal end 90*d* of the curved bar 88*d* is adapted to slide along an angled surface 400 which is provided in a hollowed space of a frame 402 (see also FIG. 26). A shaft 404 extends through an opening 406 in the frame 402, and a resilient element 70*d* (such as a spring) is retained over the shaft 404. The shaft 404 has an enlarged end 408 that retains the resilient element 70*d* between the enlarged end 408 and the frame 402. The resilient element 70*d* normally biases the frame 402 in a forward direction (see arrow F in FIG. 21) away from the housing 22*d*. As the frame 402 moves back and forth, the terminal end 90*d* of the curved bar 88*d* slides up and down along the angled surface 400 as the push button 66*d* pivots about its pivot axis 410 (see FIGS. 21–22). The push button 66*d* is normally biased outwardly away from the housing 22*d* by the resilient element 70*d* which biases the frame 402 in the forward direction F. This causes the terminal end 90*d* to slide downwardly along the angled surface 400 to the rearmost position of the angled surface 400 (see FIG. 21), which causes the curved bar 88*d* and the push button 66*d* to pivot in a counter-clockwise direction (as viewed from the orientation of FIGS. 21–22) about the pivot axis 410, biasing the push button 66*d* outwardly away from the housing 22*d*. As a result, the bias of the push button 66*d* means that the fourth contact 58*d* carried on the pusher 398 is also normally biased away from the second contact 60*d* so that the motor 50*d* is not powered by the power source 48*d* under normal (non-operation) circumstances.

Figure 24:
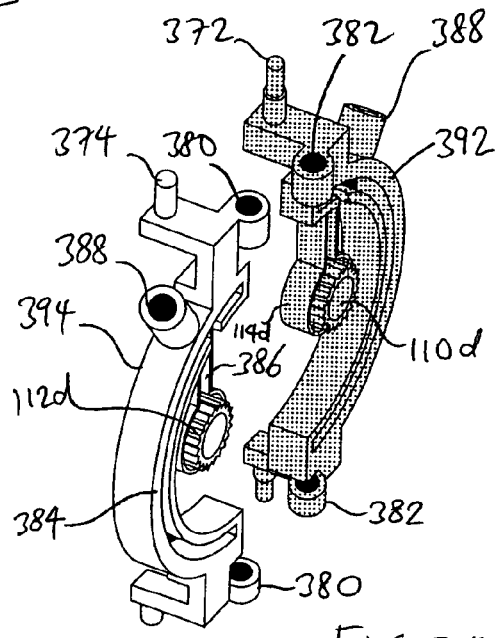
FIG. 24 is an exploded perspective view of the bubble generating device of the assembly of FIG. 16.
Figure 25:
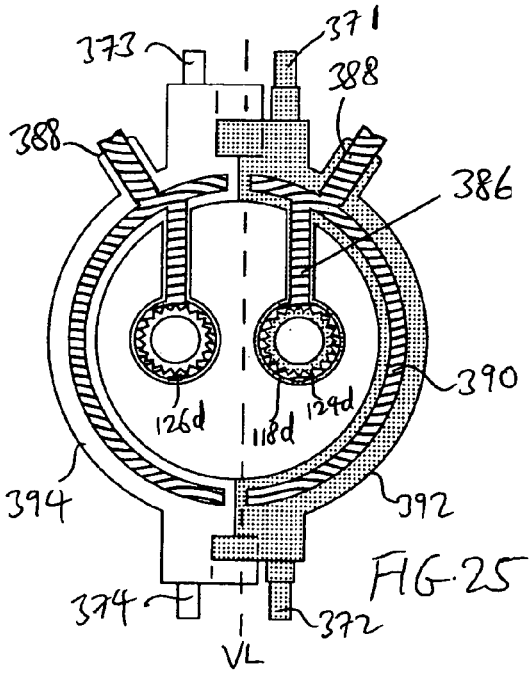
FIG. 25 is a cross-sectional view of the bubble generating device of FIG. 24.

FIGS. 24–25 illustrate the bubble generating device of the assembly 20*d*. The bubble generating device includes an outer ring 396 and a pair of bubble generating rings 110*d* and 112*d*. The rings 396, 110*d* and 112*d* are provided outside the housing 22*d*, with the rings 110*d* and 112*d* positioned within the periphery of the outer ring 396. The outer ring 396 is actually made up of two arc portions 392 and 394, each having a generally semi-circular shape and carrying one of the rings 110*d* and 112*d*, respectively. Each arc portion 392 and 394 has internal channel 390 that communicates with an inlet channel 388 and a secondary channel 386. The opposing ends of one arc portion 392 are provided with extensions 382, and the opposing ends of the other arc portion 394 are provided with aligned extensions 380. Each of the extensions 380, 382 has a hole extending therethrough. When the arc portions 392, 394 are assembled together, the extensions 380, 382 are positioned one on top of the other, and their corresponding holes are aligned (see FIG. 25) in a vertical line VL through which pivot shafts 376 and 378 (see FIG. 17) can be inserted. These pivot shafts 376, 378 extend from the housing 22*d*. The arc portions 392 and 394 are adapted to be pivoted between a closed position (see FIGS. 16 and 19), in which the front surfaces 384 of both arc portions 392, 394 contact each other, and the front surfaces 126*d* and both rings 110*d*, 112*d* also contact each other, to an opened position (see FIGS. 17, 18, 20 and 25), in which the rings 110*d*, 112*d* are positioned side-by-side in the same plane and the arc portions 392, 394 form a generally circular ring. The line VL is the pivot axis about which this pivoting motion occurs. In addition, the opposing ends of the arc portion 392 are provided with pins 371 and 372, while the opposing ends of the arc portion 394 are provided with pins 373 and 374. A plurality of outlets 370 can be provided along the front surfaces 384 of the arc portions 392, 394 (see FIG. 18), and communicating with the internal channel 390.

Each ring 110*d* and 112*d* can be almost identical in structure to the ring 110 illustrated in FIG. 7. Referring to FIGS. 7, 18, 24 and 25, each ring 110*d*, 112*d* also has an annular base piece that has a cylindrical wall extending therein to define an annular chamber 118*d* therein. An opening 120*d* (see FIG. 18) is provided in the outer wall 114*d* (see FIG. 24). Each ring 110*d*, 112*d* also has an annular cover piece that fits into the annular chamber 118*d* of the base piece. A plurality of outlets 124*d* can be provided along the inner annular surface, and/or the front surface 126*d*, of the cover piece, and communicating with the chamber 118*d*. The secondary channel 386 is connected to the opening 120*d*. Respective tubings 131*d* and 133*d* are attached to the inlet channel 388 of each arc portion 392, 394. Thus, bubble solution from the solution bottle 32*d* is delivered via the tube 46*d* and the inlet channels 388 to the internal channel 390 of each arc portion 392, 394. From the internal channel 390, the bubble solution can be delivered via the secondary channel 386 into the chambers 118*d* of the respective rings 110*d*, 112*d*. The bubble solution from the chambers 118*d* can then leak out of the outlets 124*d* onto the front surface 126*d* of the rings 110*d*, 112*d*. Similarly, the bubble solution from the internal channels 388 can leak out of the outlets 370 onto the front surface 384 of the arc portions 392, 394. When the arc portions 392, 394 and the bubble rings 110*d*, 112*d* are in their normal non-operating (i.e., closed) position, the contact between the front surfaces 126*d* of the bubble rings 110*d*, 112*d*, and between the front surfaces 384 of the arc portions 392, 394, will cause a film of bubble solution to be formed across each bubble ring 110*d*, 112*d* as well as the outer ring 396.

Figures 26, 27, 28:
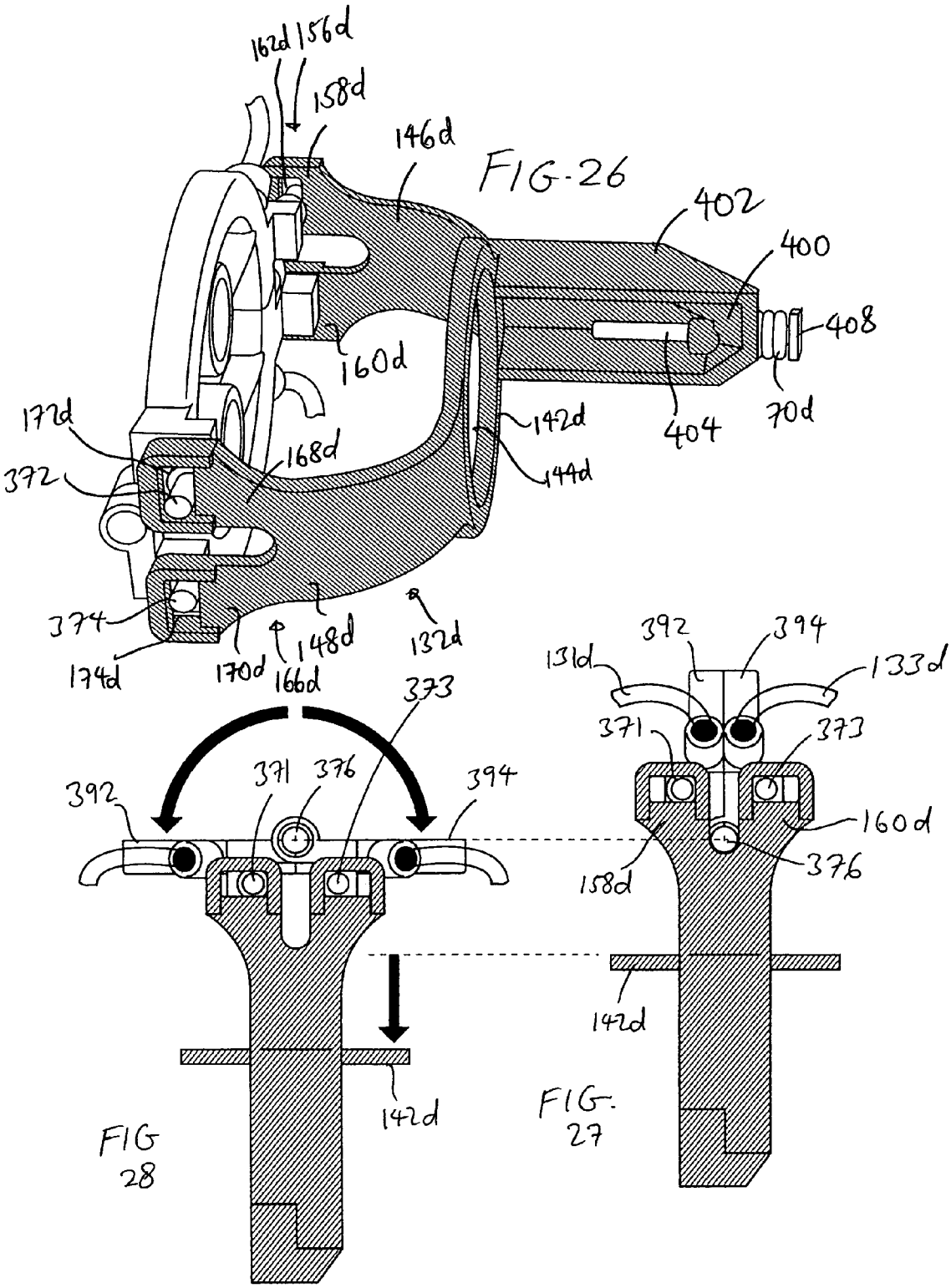
FIG. 26 is an enlarged perspective view of certain elements of the link system of the assembly of FIG. 16.
FIG. 27 is a top plan view of the link system and bubble generating device of the assembly of FIG. 16 shown with the bubble rings in the closed position.
FIG. 28 is a top plan view of the link system and bubble generating device of the assembly of FIG. 16 shown with the bubble rings in the opened position.
Figure 29:
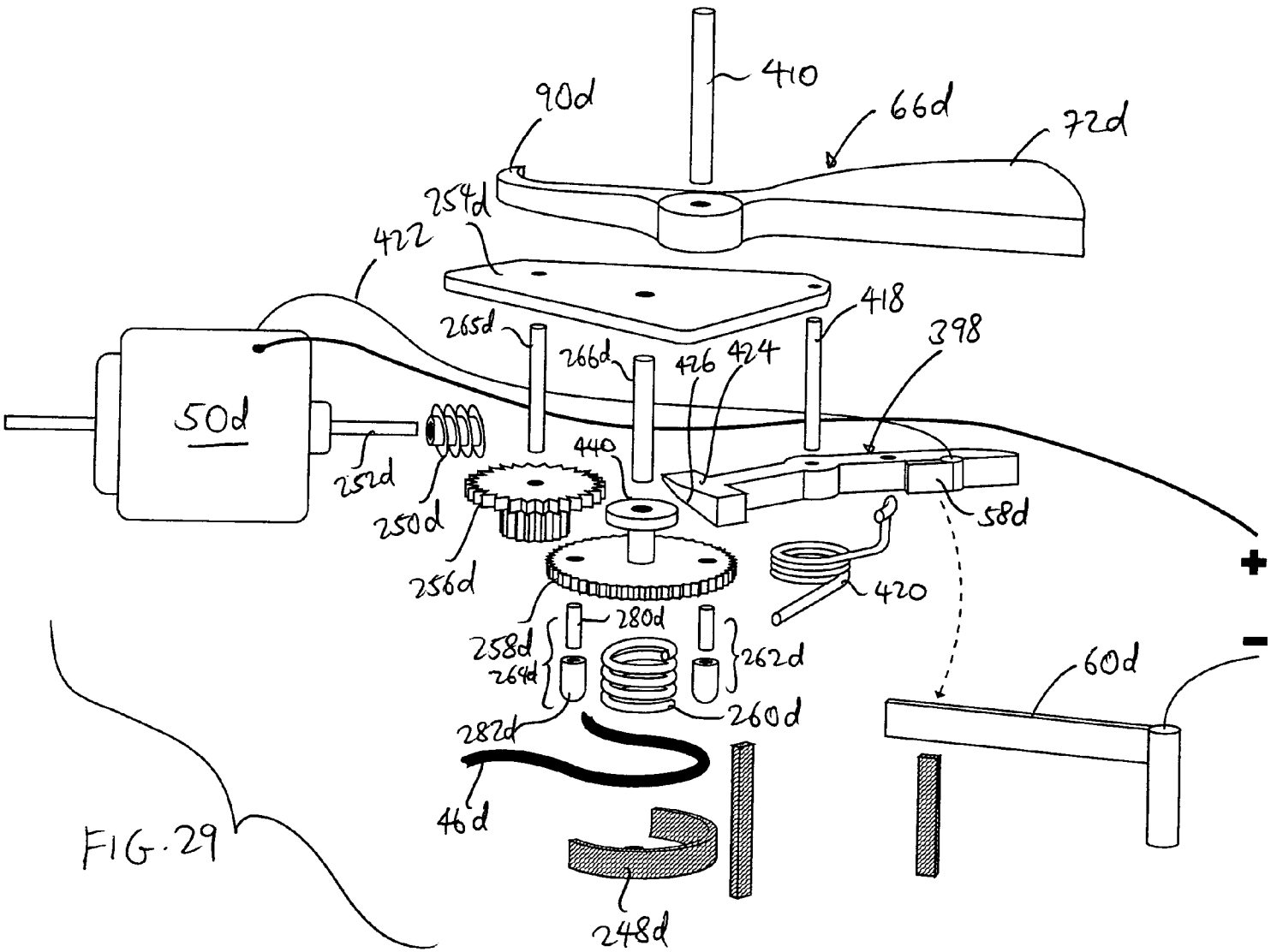
FIG. 29 is an exploded view illustrating the internal components of the assembly of FIG. 16.
Figure 30:
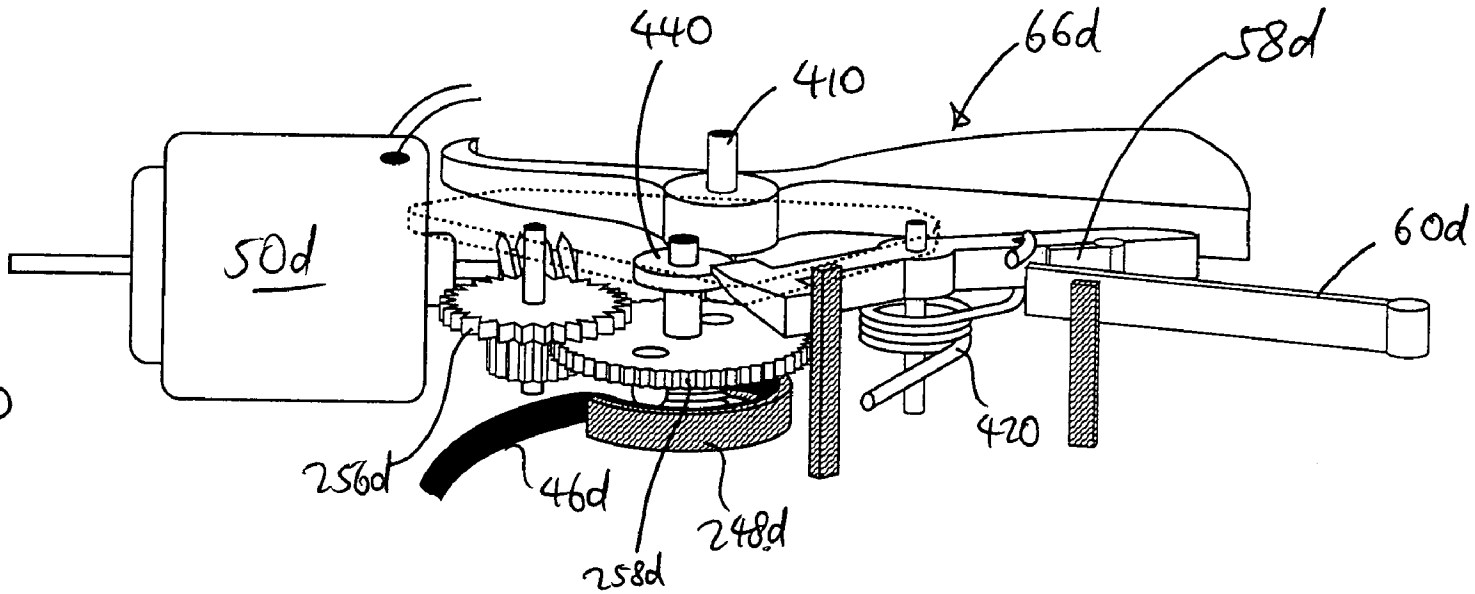
FIG. 30 is an isolated and enlarged perspective view of the pump system of the assembly of FIG. 16 in the normal non-operational condition.
Figure 31:
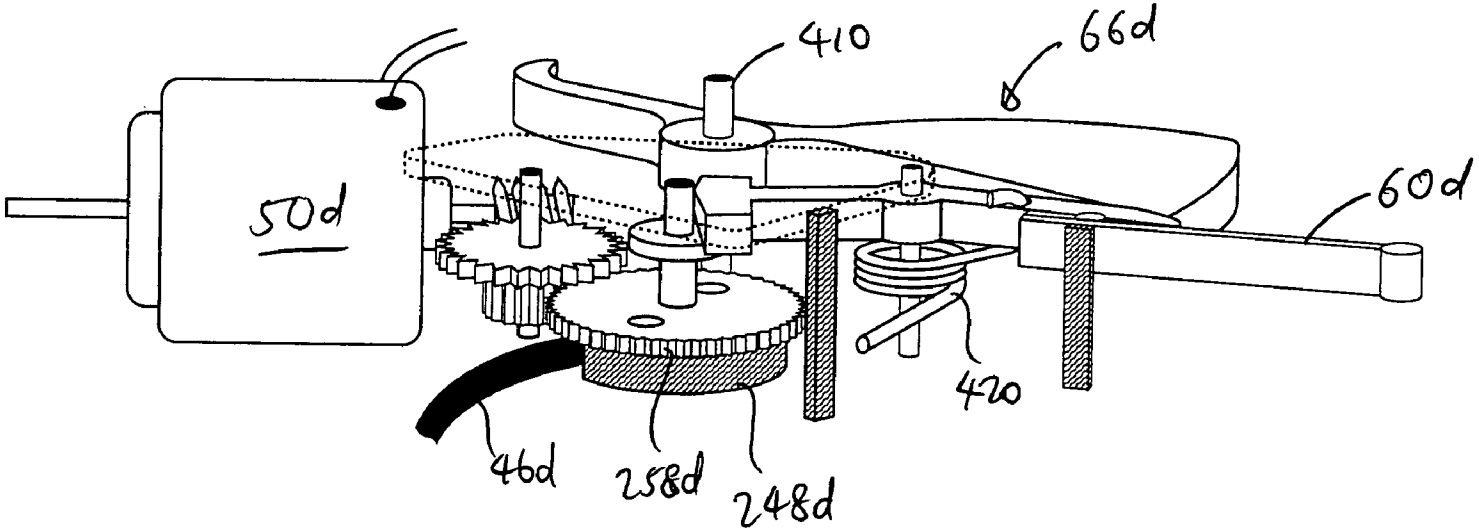
FIG. 31 is an isolated and enlarged perspective view of the pump system of the assembly of FIG. 16 in the bubble-generating position.
Figure 32:
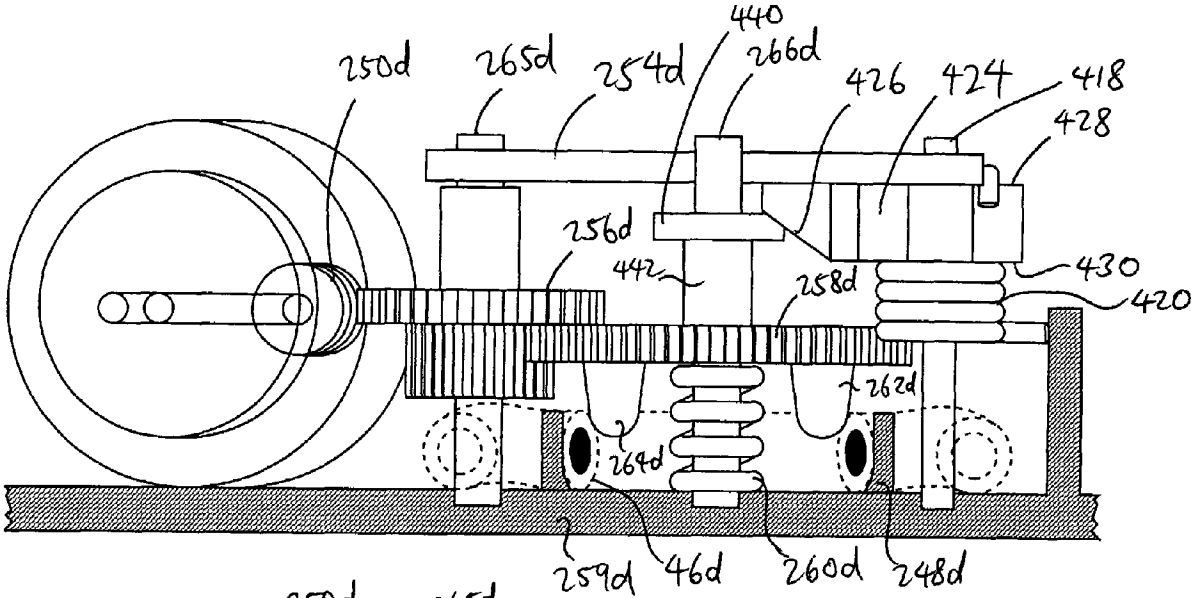
FIG. 32 is an isolated top plan view illustrating the relationship between the pressure rollers and the tube when the assembly of FIG. 16 is in the normal non-operational condition.
Figure 33:
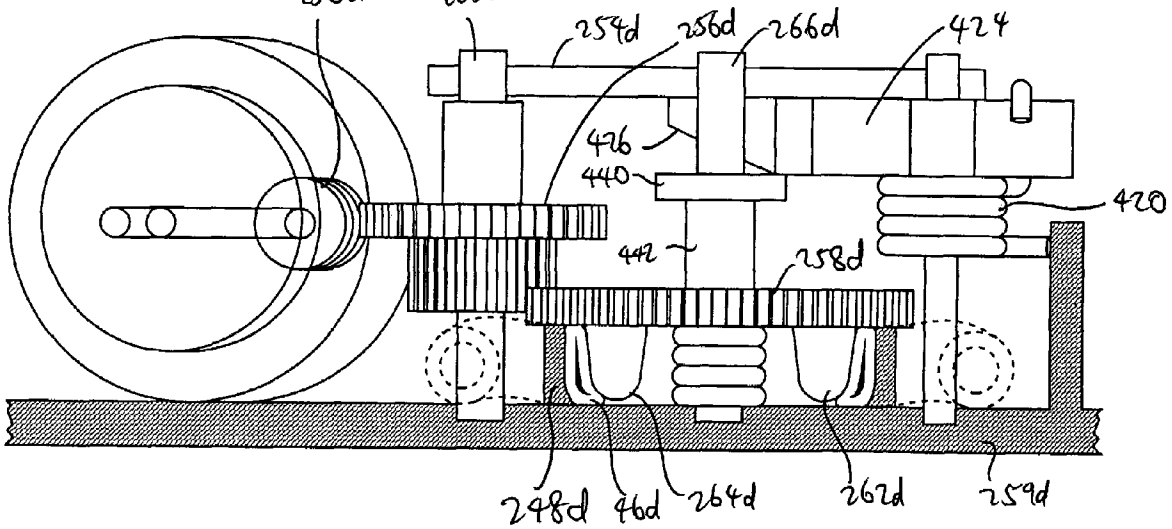
FIG. 33 is an isolated top plan view illustrating the relationship between the pressure rollers and the tube when the assembly of FIG. 16 is in the bubble-generating position.

FIGS. 21–22 and 26 illustrate the link system that operatively couples the push button 66*d* to the bubble rings 110*d*, 112*d* and the outer ring 396. The link system includes the push button 66*d*, the frame 402 and a generally U-shaped pivoting bar 132*d*. The link system causes the arc portions 392, 394 and the bubble rings 110*d*, 112*d* to move between the opened and closed positions when the push button 66*d* is pressed and released, respectively. The pivoting bar 132*d* and the rings 110*d*, 112*d* are positioned outside the housing 22*d*, while the frame 402 is positioned partially outside the housing 22*d*.

Referring to FIGS. 21, 22 and 26, the U-shaped pivoting bar 132*d* has a central section 142*d* that has an opening 144*d* through which the motor 50*d* can extend. A curved upper section 146*d* extends from one end of the central section 142*d*, and a curved lower section 148*d* extends from the other end of the central section 142*d*. The frame 402 extends from a location adjacent the upper section 146*d*. An upper U-shaped prong 156*d* extends from the top end of the upper section 146*d*, the upper U-shaped prong 156*d* having a first leg 158*d* and a second leg 160*d*. Each leg 158*d* and 160*d* has an enlarged end that has a corresponding elongated opening 162*d* and 164*d*, respectively (see also FIG. 16). Similarly, a lower U-shaped prong 166*d* extends from the bottom end of the lower section 148*d*, the lower U-shaped prong 166*d* having a first leg 168*d* and a second leg 170*d*. Each leg 168*d* and 170*d* has an enlarged end that has a corresponding elongated opening 172*d* and 174*d*, respectively. The pins 371 and 373 of the arc portions 392 and 394, respectively, are received inside the elongated openings 162*d* and 164*d*, respectively, and the pins 372 and 374 of the arc portions 392 and 394, respectively, are received inside the elongated openings 172*d* and 174*d*, respectively. Thus, the opposing ends of the arc portions 392, 394 are coupled for pivoting movement with respect to the upper section 146*d* and the lower section 148*d* of the U-shaped bar 132*d*.

Referring now to FIGS. 21, 22 and 29–33, the assembly 20*d* includes a pump system that functions to pump the bubble solution from the solution bottle 32*d* to the bubble rings 110*d*, 112*d* and the outer ring 396. The pump system includes the motor 50*d*, the tube 46*d*, the tubings 131*d*, 133*d*, a guide wall 248*d*, and a gear system that functions to draw bubble solution through the tube 46*d* and tubings 131*d*, 133*d*.

The gear system includes a motor gear 250*d* that is rotatably coupled to a shaft 252*d* of the motor 50*d*, a gear housing plate 254*d*, a first gear 256*d*, a second gear 258*d*, a resilient element 260*d* (such as a spring), two pressure rollers 262*d*, 264*d*, and two shafts 265*d* and 266*d*. The motor gear 250*d* has teeth that are engaged with the teeth of the first gear 256*d*. The first gear 256*d* is rotatably coupled to the gear housing plate 254*d* and the wall 259*d* of the housing 22*d* by the shaft 265*d*. The first gear 256*d* has teeth that are engaged with the teeth of the second gear 258*d*. The second gear 258*d* rotates about an axis defined by the shaft 266*d*, and the resilient element 260*d* is carried on the shaft 266*d* between the second gear 258*d* and the wall 259*d* of the housing 22*d*. A disk 440 is coupled parallel to the second gear 258*d* via a hollow shaft 442, with the shaft 266*d* extending inside the hollow bore of the shaft 442. The guide wall 248*d* is attached to, or positioned against, the wall 259*d* of the housing 22*d*. The pressure rollers 262*d*, 264*d* are spaced apart along the outer periphery of the second gear 258*d* and positioned to face towards the gear housing plate 254*d*. Each pressure roller 262*d*, 264*d* has a pin 280*d* and a cap 282*d* which has an interior through which the corresponding pin 280*d* can be inserted. The cap 282*d* can have a larger diameter than the pin 280*d* to better facilitate the compression of the tubing 46*d*. The second gear 258*d* is positioned adjacent the pusher 398, with the pushing end 424 of the pusher 398 positioned between the disk 440 and the gear housing plate 254*d* (see FIGS. 32 and 33). In particular, the tube 46*d* extends from the interior of the solution bottle 32*d*, through the opening 44*d* in the solution dish 40*d*, into the housing 22*d*, and passes through a path (that is defined by the pressure rollers 262*d*, 264*d*, and the guide wall 248*d*) that leads to a branch from where the tubings 131*d*, 133*d* extend.

The pump system operates in the following manner. When the motor 50*d* is actuated, the motor gear 250*d* will rotate, thereby causing the first and second gears 256*d* and 258*d* to rotate as well. As the second gear 258*d* rotates, the pressure rollers 262*d*, 264*d* will rotate as well. As the pressure rollers 262*d*, 264*d* rotate, they will apply selected pressure on different parts of the tube 46*d* in the manner described below.

The assembly 20*d* operates in the following manner. In the normal non-operational condition (i.e., when the rings 110*d*, 112*d*, and the arc portions 392, 394, are contacting each other in the closed position, as shown in FIGS. 16, 19, 21, 27, 30 and 32), the push button 66*d* is normally biased outwardly away from the housing 22 by the resilient element 70*d* in the manner explained above. When the user presses the push button 66*d* (see FIGS. 17, 18, 20, 22, 28, 31 and 33), the push button 66*d* pivots clockwise about the shaft 410 (in the orientation shown in FIGS. 20 and 22), which causes three sequences of events occur at about the same time.

First, the arc portions 392, 394 and the rings 110*d*, 112*d* are moved from their closed position to their opened position. As best shown by comparing FIGS. 21 and 22, when the push button 66*d* is pivoted in the clockwise direction, the bar 88*d* of the push button 66*d* is also pivoted in a clockwise direction which pushes the terminal end 90*d* upwardly along the angled surface 400. The upward movement of the terminal end 90*d* along the angled surface 400 pulls the frame 402 rearwardly in the direction of arrow R, thereby overcoming the normal bias of the resilient element 70*d*. Rearward movement of the frame 402 will pull the U-shaped pivoting bar 132*d* rearwardly in the direction of arrow R. The pivot axis defined by the pivot shafts 376 and 378 is fixed, as best shown by comparing FIGS. 27 and 28. Thus, the rearward movement of the pivoting bar 132*d* will cause the arc portions 392, 394 to pivot about the pivot axis defined by the pivot shafts 376, 378 when the pins 371, 372, 373, 374 slide back and forth within the elongated openings 162*d*, 172*d*, 164*d*, 174*d*, respectively (compare FIGS. 27 and 28), so as to pivot the arc portions 392, 394 (and their rings 110*d*, 112*d*) from the closed position to the opened position. In this opened position, the openings of the arc portions 392, 394 and the rings 110*d*, 112*d* (and the formed films of bubble solution) will be directly facing an air generator 300*d* which is coupled to the motor 50*d*.

The back and forth sliding motion of the pins 371, 372, 373, 374 within the elongated openings 162*d*, 172*d*, 164*d*, 174*d*, respectively, can be described as follows: when the rings 110*d*, 112*d* and arc portions 392, 394 contact each other in the position shown in FIG. 27, the pins 371, 372, 373, 374 are positioned at the inner ends of a respective elongated opening 162*d*, 172*d*, 164*d*, 174*d*. As the pivoting bar 132*d* causes the arc portions 392, 394 to pivot about the pivot axis defined by the pivot shafts 376, 378, the rings 110*d*, 112*d* and arc portions 392, 394 will move apart from each other, causing the pins 371, 372, 373, 374 to slide from the inner ends to the outer ends of the respective elongated opening 162*d*, 172*d*, 164*d*, 174*d*. When the pins 371, 372, 373, 374 reach the outer ends of the respective elongated opening 162*d*, 172*d*, 164*d*, 174*d*, the rings 110*d*, 112*d* and arc portions 392, 394 will be about ninety degrees apart from other, and further pivoting by the arc portions 392, 394 will cause the pins 371, 372, 373, 374 to slide from the outer ends back to the inner ends of the respective elongated opening 162*d*, 172*d*, 164*d*, 174*d*. When the pins 371, 372, 373, 374 reach the inner ends of the respective elongated opening 162*d*, 172*d*, 164*d*, 174*d* again, the arc portions 392, 394 and rings 110*d*, 112*d* will be about one hundred and eighty degrees apart from other, as shown in FIGS. 17, 20, 22 and 28.

Second, bubble solution is pumped to the arc portions 392, 394 and rings 110*d*, 112*d*. In this regard, the clockwise pivot of the push button 66*d* pushes the pusher 398 to pivot clockwise, so that the fourth contact 58*d* on the pusher 398 engages the second contact 60*d*, thereby forming a closed electrical circuit that will deliver power from the power source 48*d* to the motor 50*d*. The motor 50*d* will turn on, thereby causing the motor gear 250*d* to drive and rotate the first and second gears 256*d* and 258*d*. As the pressure rollers 262*d*, 264*d* on the second gear 258*d* rotate, they will apply selected pressure on different parts of the tube 46*d*. In particular, in the normal non-operational condition (i.e., when the rings 110*d*, 112*d*, and the arc portions 392, 394, are contacting each other in the closed position), the resilient element 260*d* normally biases the second gear 258*d* away from the guide wall 248*d* (see FIGS. 30 and 32), so that the pressure rollers 262*d*, 264*d* are spaced-apart from the wall 259*d*. In this position, the cap 282*d* of the pressure rollers 262*d*, 264*d* exert minimal or no pressure on the tube 46*d*. When the push button 66*d* is pressed and pivoted, the enlarged pushing region 72*d* of the push button 66*d* presses the pusher 398 to pivot in the clockwise direction (as viewed from the orientation of FIGS. 21 and 22). As the pusher 398 pivots clockwise, the pushing end 424 is pressed inside the space between the disk 440 and the gear housing plate 254*d*, with the disk 440 sliding along the ramped surface 426 of the pushing end 424 to overcome the normal bias of the resilient element 260*d*. This essentially pushes the disk 440, the second gear 258*d* and the pressure rollers 262*d*, 264*d* towards the guide wall 248*d* and the wall 259*d*. See FIGS. 31 and 33. As the pressure rollers 262*d*, 264*d* are pushed towards the guide wall 248*d* and the wall 259*d*, the cap 282*d* of the pressure rollers 262*d*, 264*d* are pushed into the tube 46*d* to compress the tube 46*d* against the guide wall 248*d*. Thus, rotation of the pressure rollers 262*d*, 264*d* will compress different portions of the tube 46*d*, thereby creating air pressure to draw the bubble solution from the interior of the solution bottle 32*d* through the tube 46*d*, on to the tubings 131*d* and 133*d*, and then into the channels 388 and 390, and then via the channel 386 into the chambers 118*d* of the rings 110*d*, 112*d*. The bubble solution will then bleed out through the outlets 124*d* on to the front surfaces 126*d* of the rings 110*d*, 112*d*, and through the outlets 370 on to the front surfaces 384 of the arc portions 392, 394.

Figure 34:
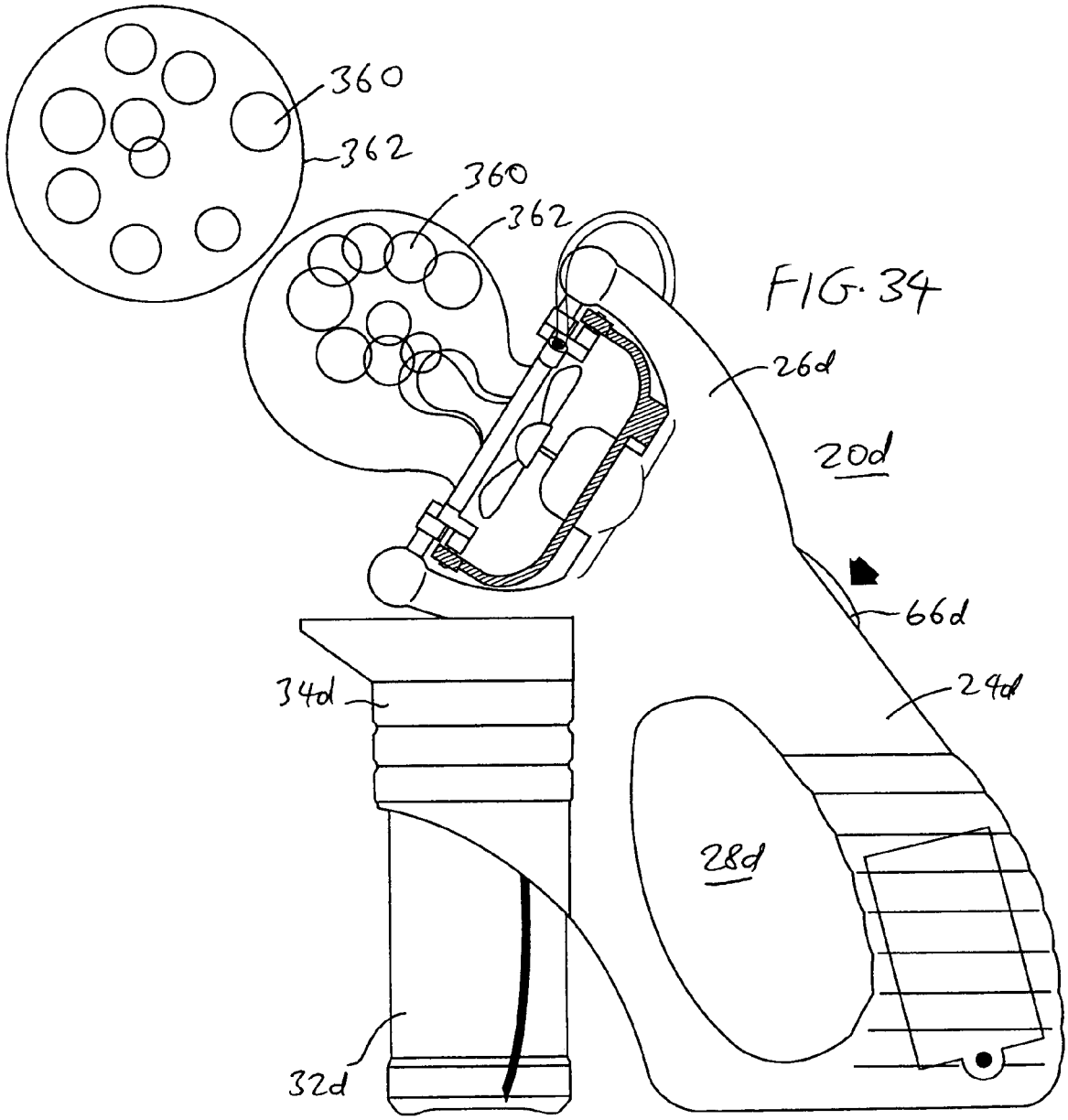
FIG. 34 is a side plan view of the assembly of FIG. 16 shown producing bubbles.

Third, the air generator 300*d* (such as a fan which extends outside the housing 22) is actuated when the motor 50*d* is turned on. In this regard, the clockwise pivot of the push button 66*d* causes the fourth contact 58*d* to engage the second contact 60*d*, thereby forming a closed electrical circuit that will deliver power from the power source 48*d* to the motor 50*d* to rotate the air generator 300*d*. The air generator 300*d* blows a stream of air towards the arc portions 392, 394 and the rings 110*d*, 112*d*. This stream of air will then travel through the films of bubble solution that have been formed over the outer ring 396 and the rings 110*d*, 112*d*, thereby creating bubbles. The rings 110*d*, 112*d* produce smaller bubbles 360, and the outer ring 396 produces larger bubbles 362, which might sometimes contain smaller bubbles 360 therein (see FIG. 34).

Thus, pressing the push button 66*d* will actuate the air generator 300*d*, and will cause the arc portions 392, 394 and the rings 110*d*, 112*d* to be positioned side-by-side to face the air generator 300*d* so that bubbles can be created. Pressing the push button 66*d* will also pump bubble solution from the solution bottle 32*d* to the arc portions 392, 394 and the rings 110*d*, 112*d*.

When the user releases his or her pressing grip on the push button 66*d*, the resilient element 70*d* will normally bias the frame 402 in the forward direction (arrow F), thereby causing the terminal end 90*d* of the push button 66*d* to slide down the angled surface 400, which pivots the push button 66*d* in a counter-clockwise direction (as viewed from the orientation of FIGS. 21 and 22) about the pivot shaft 410, biasing the push button 66*d* outwardly away from the housing 22. The natural bias of the resilient element 420 will then bias the pusher 398 in a counter-clockwise direction (as viewed from the orientation of FIGS. 21 and 22) about the pivot shaft 418, causing the contacts 58*d* and 60*d* to be disengaged so that power to the motor 50*d* is cut. As a result, the air generator 300*d* will stop producing streams of air, and the pump system will stop drawing bubble solution from the solution bottle 32*d* to the rings 110*d*, 112*d*, 396. In this regard, the pushing end 424 of the pusher 398 will be pivoted away from the disk 440 so that the natural bias of the resilient element 260*d* will push the second gear 258*d* away from the guide wall 248*d* and the wall 259*d* (i.e., from FIG. 33 to FIG. 32), so that the pressure rollers 262*d*, 264*d* will be biased away from the tubing 46*d*. In addition, the forward movement of the frame 402 will also push the U-shaped pivoting bar 132*d* forwardly in the direction of arrow F. Since the pivot axis defined by the pivot shafts 376 and 378 are fixed, forward movement of the pivoting bar 132*d* will cause the arc portions 392, 394 to pivot about the pivot axes defined by the pins 371+372 and 373+374 (in a reverse manner from that described above for the back and forth motion of the pins 371, 372, 373, 374 within the elongated openings 162*d*, 172*d*, 164*d*, 174*d*, respectively), so as to pivot the arc portions 392, 394 (and their rings 110*d*, 112*d*) from the opened position of FIGS. 17, 18, 20, 22 and 28 to the closed position of FIGS. 16, 19, 21 and 27.

In addition, as best shown in FIGS. 16–20, the solution dish 40*d* is positioned directly below the rings 110*d*, 112*d*, 396 to collect any stray droplets of bubble solution that drip from the rings 110*d*, 112*d*, 396. These stray droplets can flow back into the solution bottle 32*d* via the opening 42*d*. In addition, the solution bottle 32*d* can be removed from the housing 22*d* by threadably disengaging the neck of the solution bottle 32*d* from the connecting section 34*d*.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly comprising:

a housing;

a source of bubble solution;

a movable bubble generating device that is always positioned outside the housing;

a tubing that couples the source of bubble solution to the bubble generating device;

a motor retained inside the housing; and an air generator coupled to the motor for directing air towards the bubble generating device.

2. The assembly of claim 1, wherein the source of bubble solution is a container coupled to the housing and retaining bubble solution.

3. A bubble generating assembly comprising:

a housing;

a bubble solution supply;

a trigger mechanism;

a bubble generating device having a first bubble generating portion and a second bubble generating portion, the bubble generating device being positioned outside the housing;

a link assembly that couples the trigger mechanism and the bubble generating device in a manner in which actuation of the trigger mechanism causes the first and second bubble generating portions to experience relative movement with respect to each other; and a tubing that couples the bubble solution supply with the bubble generating device.

4. The assembly of claim 3, further including:

a motor operatively coupled to the trigger mechanism; and an air generator coupled to the motor and directing air towards the bubble generating device.

5. The assembly of claim 4, further including:

a gear system coupled to the motor and applying pressure to the tubing to cause bubble solution to be delivered from the bubble solution supply to the bubble generating device.

6. The assembly of claim 4, further including means for drawing bubble solution from the bubble solution supply, and to deliver the bubble solution to the bubble generating device.

7. The assembly of claim 6, wherein the drawing means includes the trigger mechanism, at least one rotating pressure roller and a guide wall, with the tubing positioned between the pressure roller and the guide wall when the trigger mechanism is not actuated, and with the tubing positioned between the pressure roller and the guide wall when the trigger mechanism is actuated.

8. The assembly of claim 7, wherein actuation of the trigger mechanism pushes the pressure roller towards the guide wall such that the tubing is compressed by the pressure roller.

9. The assembly of claim 3, wherein the bubble solution supply is a container coupled to the housing and retaining bubble solution.

10. The assembly of claim 9, wherein the container is removably coupled to the housing.

* * * * *